United States Patent [19]

Bevilacqua et al.

[11] Patent Number: 4,616,498

[45] Date of Patent: Oct. 14, 1986

[54] MULTI-SPINDLE ROTOPEENING APPARATUS

[75] Inventors: Bruce W. Bevilacqua, Penn Township, Westmoreland County; Ralph W. Klug, Oakmont; David C. Carlsen, Baldwin Boro; Dennis J. Dinucci, Hopewell, all of Pa.

[73] Assignee: Westinghouse Electric Corp., Pittsburgh, Pa.

[21] Appl. No.: 731,260

[22] Filed: May 7, 1985

[51] Int. Cl.[4] ..... B24C 3/16; C21D 7/06

[52] U.S. Cl. ..... 72/53

[58] Field of Search ..... 72/53, 110, 199, 234, 72/362, 365; 51/241 B

[56] References Cited

U.S. PATENT DOCUMENTS

| | | |
|---|---|---|
| 3,485,073 | 12/1969 | Burney . |
| 3,531,964 | 10/1970 | Manning, Jr. et al. . |
| 3,648,498 | 3/1972 | Voss et al. . |
| 3,654,786 | 4/1972 | Koenecke et al. . |
| 3,834,200 | 9/1974 | Winter . |
| 3,857,750 | 12/1974 | Winter et al. . |
| 3,886,774 | 6/1975 | Stromstedt et al. . |
| 4,034,585 | 7/1977 | Straub . |
| 4,354,371 | 10/1982 | Johnson . |
| 4,481,802 | 11/1984 | Harman et al. . |

FOREIGN PATENT DOCUMENTS

| | | |
|---|---|---|
| 2551996 | 8/1983 | France . |

OTHER PUBLICATIONS

"Longer Life for Metal Parts by Shot Peening," R. R. Murray, *Machine Design,* Mar. 22, 1984, pp. 57–61.

U.S. application Ser. No. 613,674, filed May 24, 1984 for "Device for Shot-Peening Inside Surface of U-Bend Region of Heat Exchanger Tubing", by Douglas Harman et al.

Technical Brochure entitled "3M Brand Roto Peen Flap Assemblies Type TC 330", Building Service and Cleaning Products Division of 3M Corp., Cleveland, Ohio.

*Primary Examiner*—Leon Gilden

*Attorney, Agent, or Firm*—L. A. DePaul

[57] ABSTRACT

A rotopeening apparatus comprising a plurality of peening spindles, a rotary and orbital drive assembly coupled to the spindles, and an oscillatory drive means for reciprocating the spindles within the interior of an array of tubes is disclosed herein. Each peening spindle includes a rotatable mandrel connected to at least one peening flapper, as well as means for orbiting the mandrel peening flapper around the longitudinal axis of the tube. The rotary and orbital drive assembly includes an orbital driveshaft and a rotary driveshaft which are concentrically disposed with respect to one another and are detachably connectable to the rotatable and orbital mandrel of the peening spindle. Finally, the oscillatory drive assembly includes a frame having a translatable saddle plate for carrying and moving the rotary and orbital drive assembly within the frame, and four threaded rods journalled within the frame and coupled to a reversible motor which are screwed through nut assemblies fixed onto the corners of the saddle plate. As the reversible motor simultaneously rotates the threaded rods, the saddle plate translates and reciprocates the peening spindle detachably connected to the rotary and orbital drive assembly in "riding nut" fashion. The apparatus is particularly useful in simultaneously rotopeening a plurality of heat exchange tubes mounted within the tubesheet of a nuclear steam generator.

38 Claims, 22 Drawing Figures

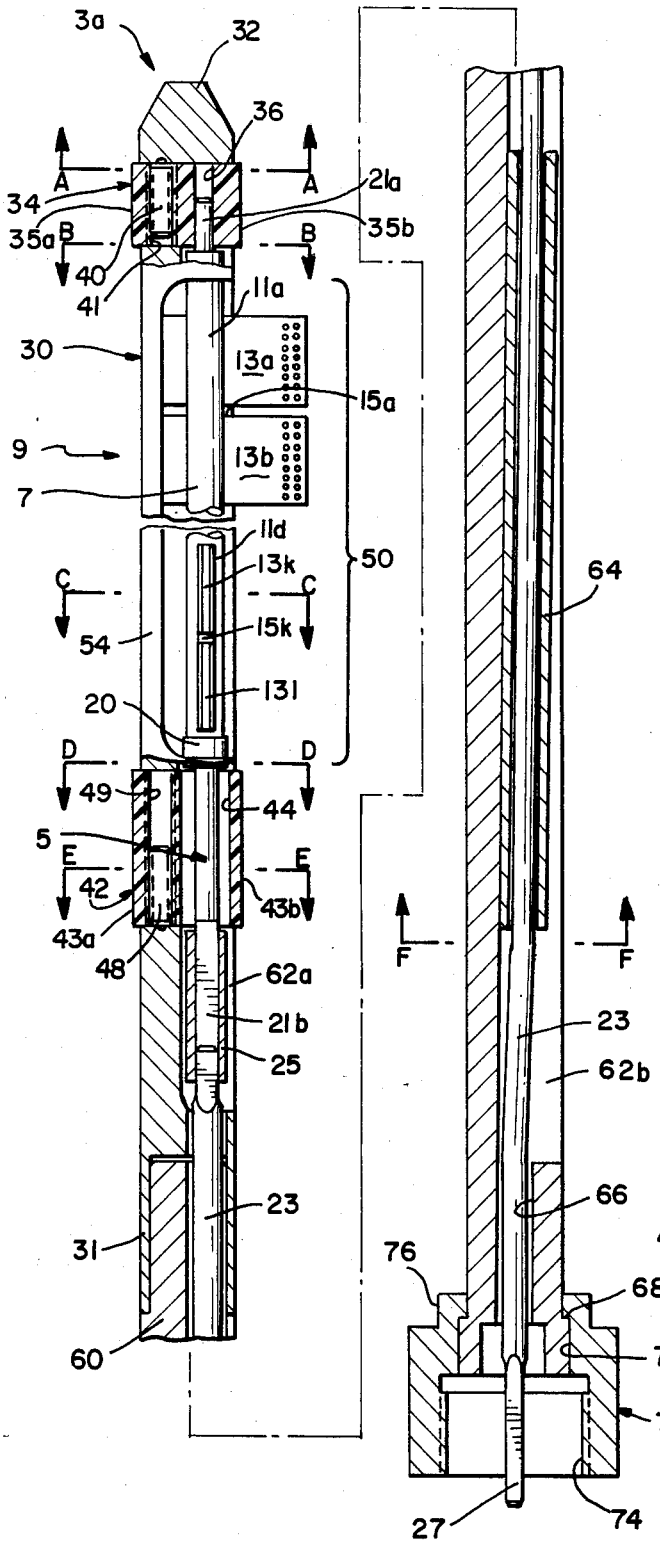
FIG 5F
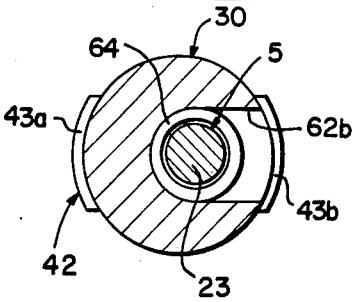
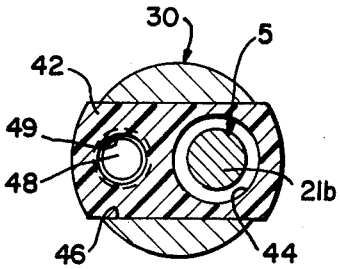
FIG 5E
FIG 4

FIG 5D
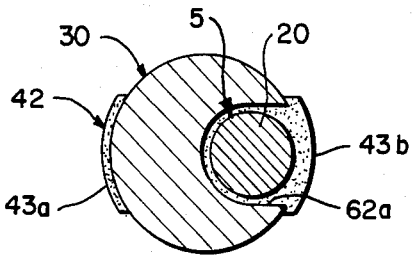
FIG 5C
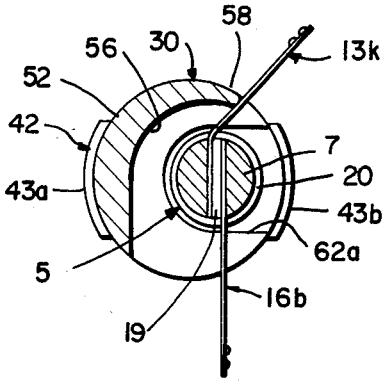
FIG 5B
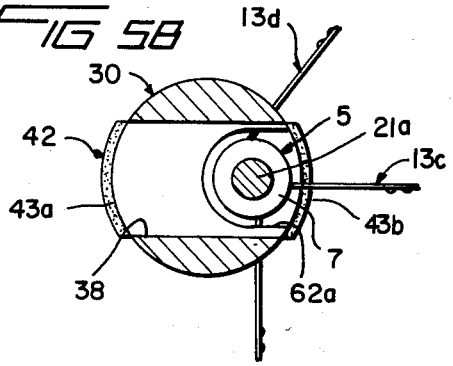
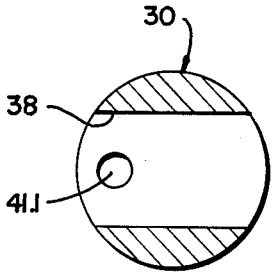
FIG 5A
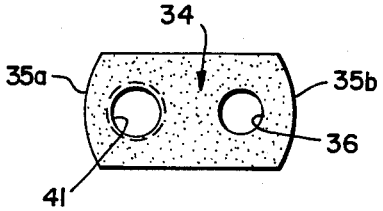
FIG 6A
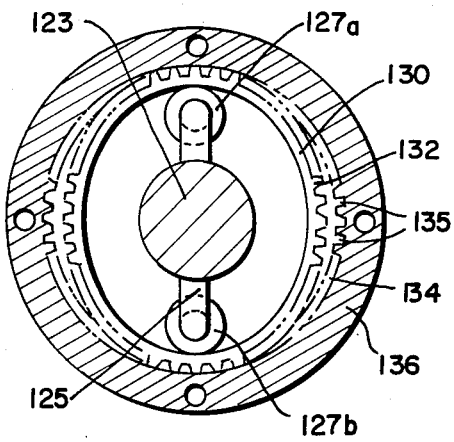
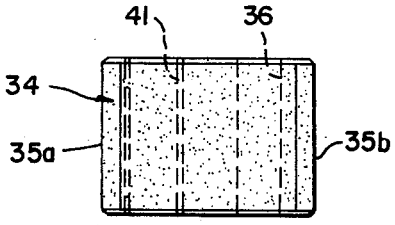
FIG 6B
FIG 7B 208c
208b
84
227
228b
230b
234c
217
234d
242
204
215
207
234a
228a
208d
208a
213b
213a
211j
211i
211h
211g
211f
211a
211b
210
211c
211d
211e

MULTI-SPINDLE ROTOPEENING APPARATUS

BACKGROUND OF THE INVENTION

1. Field of the Invention

This invention relates to peening devices for peening the interior walls of a plurality of metallic tubes, thereby cold-working them. It is particularly useful in rotopeening a group of heat exchange tubes mounted in the tubesheet of a nuclear steam generator in order to relieve stresses in the tubes.

2. Description of the Prior Art

Devices for peening the inside walls of metallic tubes are generally known in the prior art. Such devices are particularly useful in relieving or at least equilibrating the tensile stresses which may be induced across the wall of a metallic tube when that tube is radially expanded, as by a hydraulic mandrel or a cold-rolling tool. Such stress-causing expansions are routinely performed in the heat exchange tubes of nuclear steam generators, particularly in the sections of the tubes extending through the generator tubesheet, both during the manufacture and maintenance of the nuclear steam generator. Unfortunately, the resulting tensile stresses can lead to an undesirable phenomenon known as "stress corrosion cracking" in the tube walls if these stresses are not relieved. But in order to fully understand the dangers associated with such stress corrosion cracking, and the utility of the invention in preventing such cracking, some general background as to the structure, operation and maintenance of nuclear steam generators is necessary.

Nuclear steam generators are comprised of three principal parts, including a secondary side and a tubesheet, as well as a primary side which circulates water heated from a nuclear reactor. The secondary side of the generator includes a plurality of U-shaped tubes, as well as an inlet for admitting a flow of feedwater. The inlet and outlet ends of the U-shaped tubes within the secondary side of the generator are mounted in the tubesheet which hydraulically separates the primary side of the generator from the secondary side. The primary side in turn includes a divider sheet which hydraulically isolates the inlet ends of the U-shaped tubes from the outlet ends. Hot, radioactive water flowing from the nuclear reactor is admitted into the section of the primary side containing all of the inlet ends of the U-shaped tubes. This hot, radioactive water flows through these inlets, up through the tubesheet, and circulates around the U-shaped tubes which extend within the secondary side of the generator. The hot, radioactive water from the reactor transfers its heat through the walls of the U-shaped tubes to the non-radioactive feedwater flowing through the secondary side of the generator, thereby converting the feedwater to non-radioactive steam which in turn powers the turbines of an electric generator. After the water from the reactor circulates through the U-shaped tubes, it flows back through the tubesheet, through the outlets of the U-shaped tubes, and into the outlet section of the primary side, where it is recirculated back to the nuclear reactor.

The walls of the heat exchange tubes in such nuclear steam generators can suffer a number of different forms of corrosion degradation, including denting, stress corrosion cracking, intragranular attack, and pitting. In situ examination of the tubes within these generators has revealed that most of this corrosion degradation occurs in what are known as the crevice regions of the generator. The prinicipal crevice region for each of the U-shaped tubes is the annular space between the heat exchange tube and the bore in the tubesheet through which the tube extends. Corrosive sludge tends to collect within this crevice from the effects of gravity. Moreover, the relatively poor hydraulic circulation of the water in this region tends to maintain the sludge in this annular crevice, and to create localized "hot spots" in the tubes adjacent the sludge. The heat radiating from these "hot spots" acts as a powerful catalyst in causing the exterior walls of the heat exchange tubes to chemically combine with the corrosive chemicals in the sludge.

While most nuclear steam generators include blowdown systems for periodically sweeping the sludge out of the generator vessel, the sludges in the tubesheet crevice regions are not easily swept away by the hyraulic currents induced by such systems. Despite the fact that the heat exchange tubes of such generators are typically formed from corrosion-resistant Inconel stainless steel, the combination of the localized regions of heat and corrosive sludge can ultimately cause the walls of the heat exchange tubes to crack, and to leak radioactive water from the primary side into the secondary side of the generator, thereby radioactively contaminating the steam produced by the steam generator.

In order to prevent such corrosion and tube-cracking from occurring in the annular crevices surrounding the tubes in the tubesheet, various processes have been developed for radially expanding the sections of the tubes extending through the tubesheets so as to eliminate the annular space between the bores in the tubesheet and the heat exchange tubes. Such radial expansions may be implemented by hydraulic mandrels capable of applying fluid pressures of near 10,000 psi across selected sections of the tubes, or by cold-rolling tools which utilize pitched, tapered rollers capable of screwing into the open ends of the tubes, thereby widening them. However, such tube expansions create tensile stresses throughout the walls of the tubes in the tubesheet region which render them more susceptible to corrosion, thereby partially defeating the purpose of the tube expansion. Because the metal around the inner diameter of the tube was expanded a relatively greater amount than the metal forming the outer diameter of the tube, most of the tensile stress caused by the radial expantion was concentrated in the inner wall of the tube.

In order to relieve this tensile stress, shot peening processes were developed for hardening the inner walls of the expanded tubes. Such shot peening processes generally employed a nozzle which was slidably insertable through the open ends of the tubes in the tubesheet and which was capable of radially firing a large volume of tiny zirconia balls against the inner wall of the tube. The resulting high-velocity impingement of the hard, zirconia "shot" relieved much of the stress in the tube walls by compressibly work-hardening the inner wall of the tube. Since stress corrosion (and consequent cracking) seems to occur only in those regions of the tube walls which have undergone a threshold stress of between 10 and 15 kilo-pounds per square inch, the relief of the regions suffering maximum stress to a level less than 10 kilo-pounds substantially reduced the likelihood of stress corrosion.

Unfortunately, such prior art shot-peening processes are not without shortcomings. For example, if the motion of the peening nozzle along the longitudinal axis of the tube is not carefully controlled, a non-uniform peening pattern may result in the interior wall of the tube. Worse yet, if the peening nozzle should accidentally remain stationary for any significant amount of time during the shot-peening process, the high-velocity balls of zirconia can create new stress patterns in the walls of the tube which exceed the threshold stress limit for stress corrosion cracking to occur, and can even break completely through the tube walls, depending upon how long they remain stationary within the tube. Still other problems arise from the fragmented zirconia which becomes stuck in the inner walls of the tubes. Such fragments must be cleaned out of these tubes by means of a rotating, abrasive tool. This not only necessitates another time-consuming (and hence expensive) step in the maintenance procedure, but also creates a cloud of radioactive zirconia dust which may contaminate non-radioactive areas of the plant if this dust is not captured and disposed of properly. Additionally, the constant recirculation of the peening shot tends to change its peening characteristics, which in turn adversely affects the uniformity of the peening pattern created in the inner walls of the tubes even when the nozzle is moved at a uniform speed through the tube. Finally, such shot-peening processes are generally capable of only peening one tube at a time, which again renders the process slow and expensive due to the large amount of plant "down-time" that the process necessitates.

Clearly, there is a need for a peening apparatus capable of quickly and uniformly peening the inner walls of the heat exchange tubes mounted within the tubesheet of a nuclear steam generator. Ideally, such an apparatus should be able to simultaneously peen the walls of a plurality of tubes, in order to minimize the time (and hence the expense) of the peening procedure. Finally, such an apparatus should be able to peen the walls of such tubes without inducing other corrosion-inducing stresses in the tube wall, and without creating a cloud of potentially-contaminating radioactive dust.

SUMMARY OF THE INVENTION

In its broadest sense, the invention is a rotopeening apparatus for rotopeening the inside wall of a conduit which comprises at least one peening spindle having a peening means, a rotary and orbital drive assembly coupled to the peening means for simultaneously rotating and orbiting the peening means within a conduit, and an oscillatory drive means for reciprocating the rotating and orbiting peening means within the conduit. Preferably, each peening spindle is rigid, and includes a rotatable mandrel connected to its peening means, as well as a means for orbiting its mandrel around the longitudinal axis of the conduit. The rotary and orbital drive means may include a drive train having a rotary drive shaft and an orbital drive shaft coupled to both the mandrel and the mandrel orbiting means. Finally, the oscillatory drive assembly may have means for both registering each spindle with the open end of a conduit, and for inserting the peening means of the spindle a desired extent into the conduit, as well as means for reciprocating the peening means within the conduit while the rotary and orbital drive assembly rotates and orbits the peening means.

In the preferred embodiment, the oscillatory drive assembly includes a frame for carrying the rotary and orbital drive assembly. This frame may be equipped with a guide plate having at least one aperture for guiding the rigid spindle into the open end of the conduit during the insertion process. This frame may also have at least one expandable collet on its upper end in order that the spindles connected to the rotary and orbital drive assembly might be positioned into registry with the open ends of the tubes mounted within the tubesheet. The oscillatory drive assembly may further have a means for both indexing and reciprocating the rotary and orbital drive assembly within the frame. This indexing and reciprocating means is preferably formed from at least one threaded rod whose ends are journalled within the frame, and whose threads are engaged to a translatable saddle plate which in turn carries the rotary and orbital drive assembly. The threaded rod may be coupled to the output shaft of a reversible motor. The reversible motor may translate the rotary and orbital drive assembly and the spindle attached thereto by rotating the threaded rod so that the saddle plate moves along the longitudinal axis of the rod in "riding nut" fashion. Further, the oscillatory drive assembly may have a control means in the form of an optical encoder optically coupled to the output shaft of the reversible motor, and electrically connected to a computer circuit. The control means may include one or more limit switches mechanically mounted on the bottom portion of the frame and electrically connected to the computer circuit for stopping the motor when the saddle plate carries the rotary and orbital drive assembly to its lower limit within the frame.

Finally, the rotary and orbital drive assembly may include a drive train having an output gearbox which includes a plurality of orbital drive shafts having rotary drive shafts concentrically disposed therein, in order that the rotopeening device might drive a plurality of peening spindles and simultaneously rotopeen an array of tubes. Preferably, the orbital drive shafts and their respective concentrically disposed rotary drive shafts are arrayed in the same configuration as the open ends of the plurality of conduits to be rotopeened in order that the peening spindles connected to these shafts might be simultaneously registered and inserted within the open ends of these conduits.

The apparatus of the invention is particularly useful in simultaneously rotopeening the open ends of a group of heat exchange tubes mounted within the tubesheet of a nuclear steam generator.

BRIEF DESCRIPTION OF THE SEVERAL FIGURES

FIG. 4 is a partial, cross-sectional side view of the spindle illustrated in FIG. 2;

FIGS. 5A, 5B, 5C, 5D, 5E and 5F are cross-sectional views of the spindle illustrated in FIG. 4 across sections AA, BB, CC, DD, EE and FF;

FIGS. 6A and 6B are top and side views of the self-lubricating plastic bearings which journal the mandrel of the spindle across the peening cage in an off-center fashion;

FIG. 7B is a cross-sectional side view of the harmonic drive assembly used in the input gear assembly;

DETAILED DESCRIPTION OF THE PREFERRED EMBODIMENT

General Overview of the Structure and Function of the Invention

Figure 1:
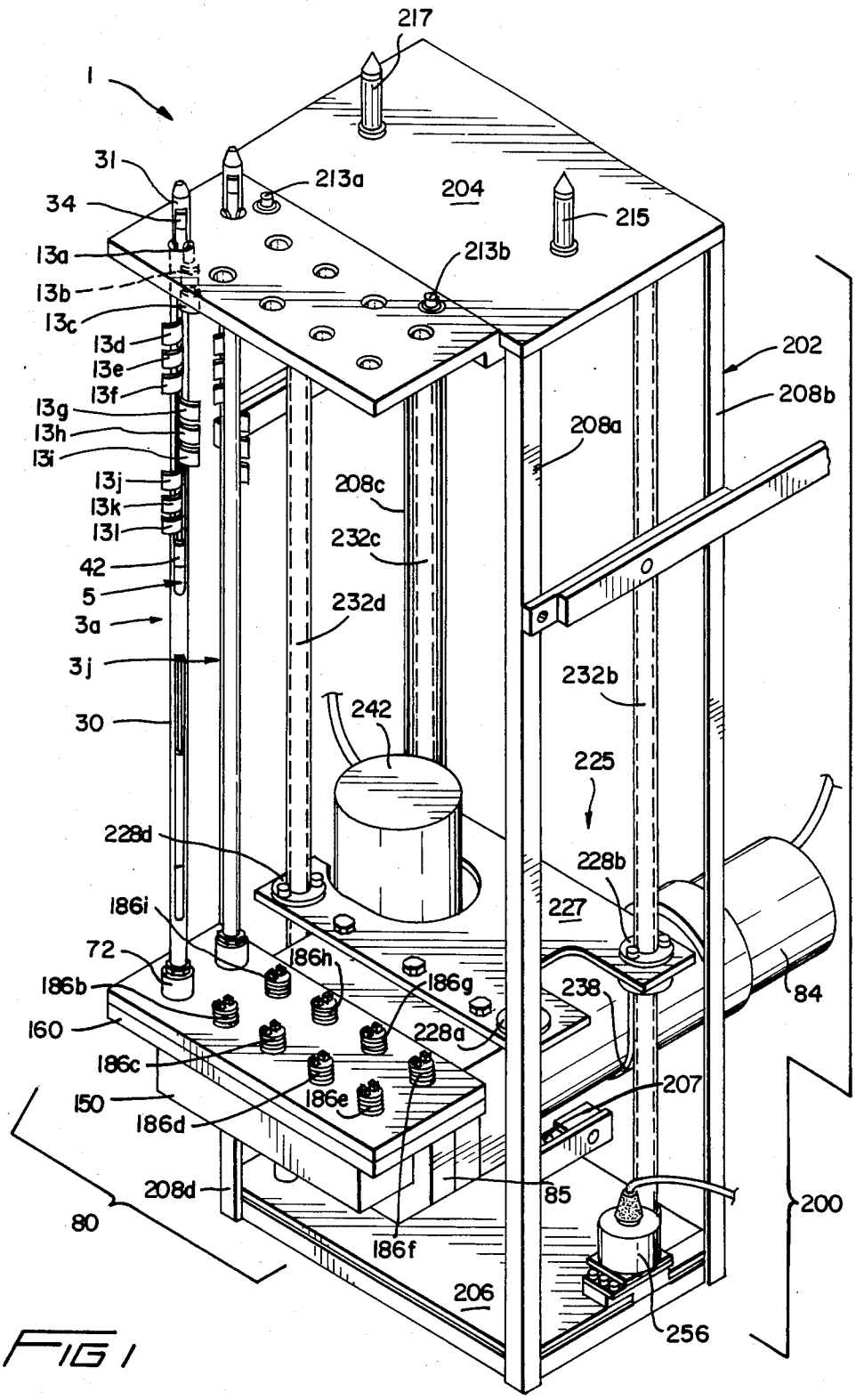
FIG. 1 is a perspective view of the preferred embodiment of the multi-spindle, rotopeening apparatus of the invention, illustrating the rotopeening spindles, the rotary and orbital drive assembly, and the oscillatory drive assembly used in the invention.

With reference to FIG. 1, wherein like numerals, designate like components throughout all of the several Figures, the multi-spindled rotopeening device 1 of the invention generally comprises a set of ten rigid peening spindles 3*a*–3*j*, each of which includes a rotatable mandrel 5 which holds at least twelve peening flappers 13*a*–13*l*. Each of the spindles 3*a*–3*j* further includes a spindle housing 30 having a top cylindrical housing 31 which is provided with a cage 50. As will be described in more detail hereinafter, the cage 50 of each of the spindles 3*a*–3*j* maintains the alignment between a pair of plastic, self-lubricating bearings 34, 42 which journal the mandrel 5 in an off-center manner relative to the longitudinal axes of the spindles 3*a*–3*j*, and control the stand-off distance between the peening balls 18 and the inner wall of the tube being peened.

Figure 9:
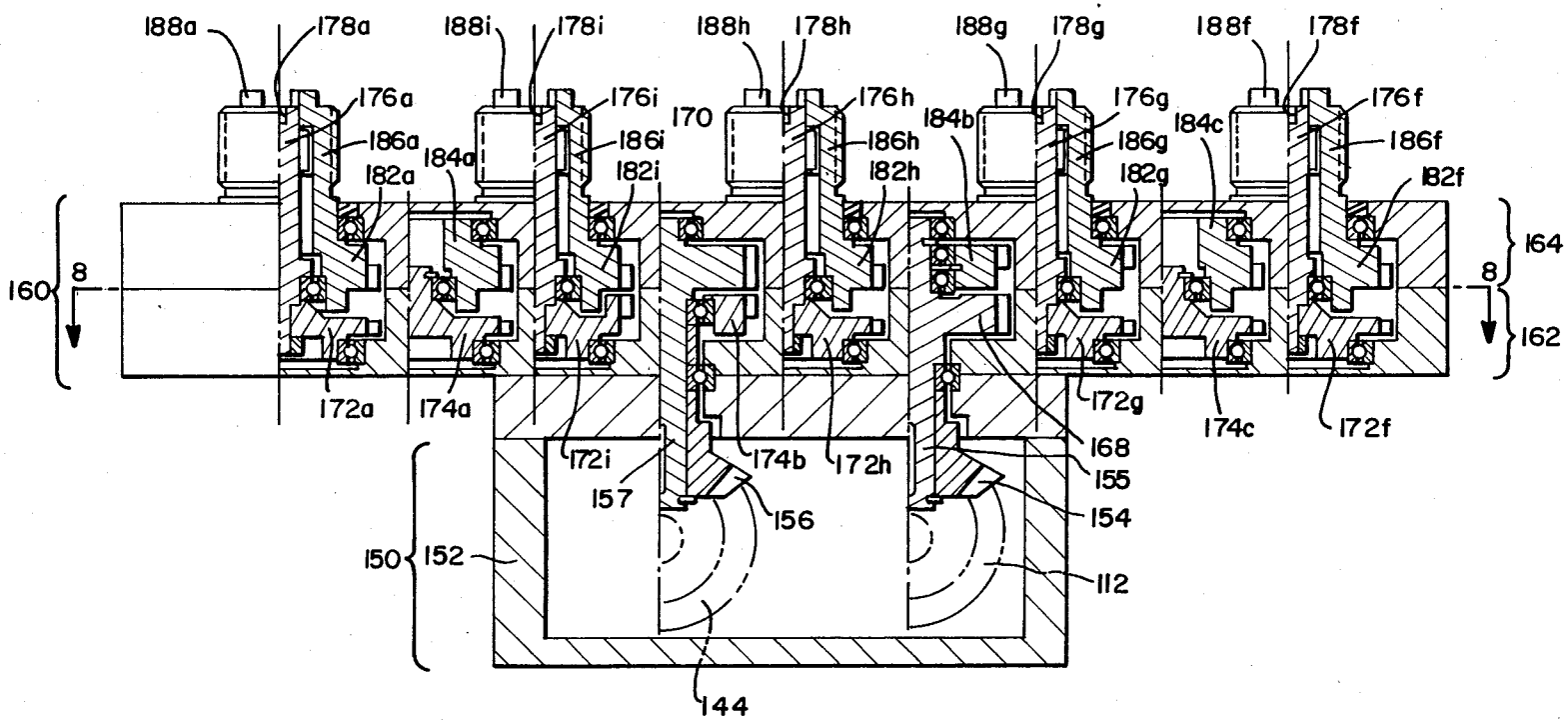
FIG. 9 is a partial, cross-sectional side view of the multi-spindle output gearbox illustrated in FIG. 8.

Both the mandrel 5 and the top cylindrical housings 31 of each of the spindles 3*a*–3*j* are detachably coupled to a rotary and orbital drive assembly 80. This rotary and orbital drive assembly 80 has a drive train 82 formed from an electric motor 84, an input gear assembly 85, a miter gearbox 150 and a multi-spindle output gearbox 160. The output gearbox 160 in turn includes ten rotary output shafts 176*a*–176*j* which are concentrically disposed within ten orbital output shafts 186*a*–186*j* (as best seen in FIG. 9) for rotating and orbiting the mandrels 5 and the cages 50 of each of the spindles 3*a*–3*j*, respectively. The square (or triangular) pitch of the orbital output shafts 186*a*–186*j* is preferably equal to the square (or triangular) pitch of the heat exchange tubes 4 mounted in the tubesheet 221 of a nuclear steam generator in order that the spindles 3*a*–3*j* may simultaneously rotopeen ten contiguous tubes 4 within the tubesheet 221.

The last principal component of the multi-spindle rotopeening device 1 is the oscillatory drive assembly 200. This drive assembly 200 includes a frame 202 having rectangular top and bottom support plates 204, 206 connected together at their corners by means of angular leg members 208*a*–208*d*. The top support plate 204 includes a guide plate 210 having an array of apertures 211*a*–211*j* for registering and guiding the ends of the spindles 3*a*–3*j* into the open ends of the tubes 4 in the tubesheet 221. The top support plate 204 also includes a pair of expandable collets 215, 217 insertable within the open ends 219 of the tubes 4 for mounting the array of apertures 211*a*–211*j* into registry with the open ends 219 of the tubes 4. Finally, this component includes an indexing and reciprocating mechanism for vertically translating and oscillating the rotary and orbital drive mechanism 80 (and the rigid spindles 3*a*–3*j*, within the tubes 4) as the peening flappers 13*a*–13*l* are forcefully whipped against the inner walls of these tubes 4. This indexing and reciprocating mechanism 225 generally includes a saddle plate 227 which supports the rotary and oscillatory drive assembly 80 within the frame 202 by means of a U-shaped bracket 238. The saddle plate 227 includes four bronze nut assemblies 228*a*–228*d* in each of its corners. These nut assemblies 228*a*–228*d* are threadedly engaged to four threaded, rotatable rods 232*a*–232*d*. Each of the rods 232*a*–232*d* is journalled at its top and bottom ends to the rectangular top and bottom support plates 204 and 206 of the frame 202, and each may be simultaneously rotated either clockwise or counterclockwise by means of a rod rotating assembly 240. When the rods 232*a*–232*d* are simultaneously rotated, the rotary and oscillatory drive assembly 80 is translated or oscillated within the frame 202 in "riding nut" fashion. Finally, to facilitate portability, the bottom profile of the device 1 matches the profile 260 of the generator bowl.

Specific Description of the Structure and Function of the Invention

Figures 2, 3A, 3B:
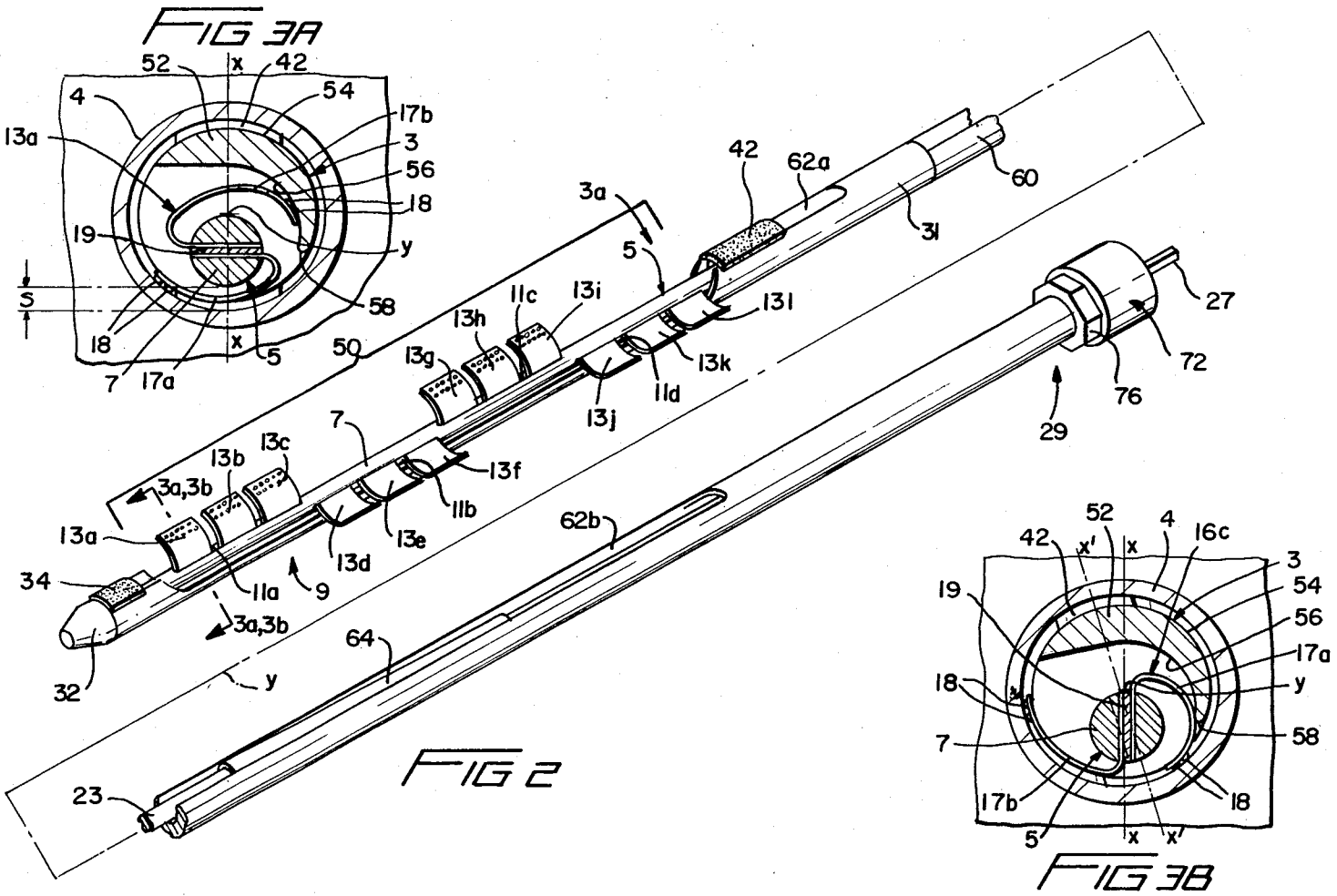
FIG. 2 is a perspective view of one of the rotopeening spindles of the invention.
FIGS. 3A and 3B are cross-sectional views of the cage of the peening spindle illustrated in FIG. 2, showing how the peening flapper is attached to the rotating and orbiting mandrel journalled within the spindle whippingly strike the inside wall of a tube being peended.

With reference now to FIGS. 2, 3A, 3B and 4, each of the rigid spindles 3*a*–3*j* contains a rotatable mandrel 5 which is journalled in an off-center relationship with respect to the longitudinal axis of its respective spindle. The mandrel 5 of each of the spindles 3*a*–3*j* includes a rigid, enlarged section 7 near the distal end 9 of the spindle. This enlarged section 7 includes four slots 11*a*–11*d* for receiving and holding the twelve peening flappers 13*a*–13*l* in four groups of three. As is evident from FIGS. 2 and 4, each of these slots 11*a*–11*d* is orthogonally disposed with respect to its neighbors. Additionally, a small gap 15*a*–15*l* is interposed between each of the flappers 13*a*–13*l*. Such gapping advantageously reduces the air resistance of the flappers, and hence reduces the amount of mandrel torque needed to peen at a given level. While the gaps illustrated in FIGS. 2 and 4 are small relative to the length of the flaps 13*a*–13*l*, they may be as wide as the flaps themselves so long as the amplitude of the oscillatory movement (discussed in detail hereinafter) is lengthened commensurately. As is best seen with respect to FIGS. 3A and 3B, each of the peening flappers 13*a*–13*l* includes a pair of rectangular flap leaves 17*a*, 17*b*. Each of the flap leaves 17*a*, 17*b* in turn includes an array of peening balls 18 on its outer edge. In the preferred embodiment, two rows consisting of eight peening balls each are mounted on the outer edges of the flap leaves 17*a*, 17*b*. The peening balls 18 are preferably about 40/1,000ths of an inch in diameter, and are formed from a hard material such as tungsten carbide. Each of the flap leaves 17*a*, 17*b* is preferably formed from a flexible composite of fiberglass and epoxy resin. Additionally, the inner edges of each of the flap leaves 17*a*, 17*b* are preferably laminated over a resilient mounting pad 19. The thickness of the laminate formed by the mounting pad 19 and the two outer edges of the flap leaves 17*a*, 17*b* is slightly greater than the thickness of each of the slots 11*a*–11*d* so that the peening flappers 13*a*–13*l* may be frictionally secured within the slots 11*a*–11*d* by merely inserting the laminated mounting plate 19 into its respective slot in the position illustrated in FIGS. 3A and 3B. Flappers conforming to the aforementioned specifications are available from the Building Service and Cleaning Products Division of Minnesota Mining & Manufacturing Company of Cleveland, Ohio.

With reference now to FIG. 4, the rigid, enlarged section 7 of the mandrel 5 includes an axle portion 20 near its proximal end, and terminates in a shaft portion 21*a* at its distal end. Shaft portion 21*a* and axle portion 20 journal the rigid, flapper-containing section 7 of the mandrel within the self-lubricating bearings 34 and 42, respectively. Each of these bearings 34 and 42 includes a bore 36 and 44 for receiving the shaft portion 21*a* and axle portion 20 of the enlarged section 7 of the mandrel 5, respectively. Instead of being concentrically aligned with the longitudinal axis of the spindle 3*a*, these bores 36 and 44 are deliberately radially displaced from the longitudinal axis of the spindle 3*a* so that the enlarged section 7 is journalled within the spindle 3*a* in an off-center relationship. In the preferred embodiment, bores 36 and 44 are radially displaced to the extent necessary to achieve a desired stand-off distance "S" between the inner edges of the flapper leaves 17*a*, 17*b* and the inside surface of the tube 4 (which is illustrated in FIG. 3A). As will be discussed in more detail hereinafter, the stannd-off distance S is generally chosen to be between 60 and 125 mils. Directly behind axle portion 20 is coupling portion 21*b* which serves to connect the rigid, enlarged section 7 of the mandrel 5 with a flexible section 23 of the mandrel 5 formed from a flexible, right-hand, drive-type coupling material having a 0.150 inch core diameter. Such flexible coupling material is available from Stow Manufacturing Company of Binghamton, N.Y. The shaft portion 21*b* of the rigid, enlarged section 7 is connected to the flexible section 23 of the mandrel 5 by means of a cylindrical coupling 25 which is rotatable within a U-shaped cavity 62*a*. As is best seen in FIG. 4, this flexible section 23 of the mandrel 5 terminates in a rigid, square shaft 27 at its proximal end.

Each of the spindles 3*a*–3*j* includes a rigid spindle housing 30 formed from a top cylindrical housing 31 which is screwed into a bottom cylindrical housing 60. The outer diameter of both the top and bottom cylindrical housings 31 and 60 is somewhat less than the inner diameter of the wall of the tubes 4 being peened so that the spindles 3*a*–3*j* may be easily inserted into and withdrawn from the open ends 219 of these tubes 4. At its distal end 9, the top cylindrical housing 31 terminates in an end portion 32 which is tapered to facilitate the insertion of the end of the spindle 3*a* into the mouth of a tube 4. Immediately under the tapered end portion 32 is the previously mentioned self-lubricating bearing 34. In the preferred embodiment, bearing 34 is formed from an easily machined, self-lubricating plastic such as Delrin ®. As is best seen with respect to FIGS. 5A, 6A and 6B, bearing 34 is generally shaped like a rectangular prism whose shortest sides 35*a*, 35*b* are arcuate in shape. The maximum outer diameter of bearing 34 is chosen so that it is slightly less than the inner diameter of the tubes 4 to be rotopeened, but greater than the outer diameter of the spindle housing 30. Such dimensioning prevents metal-to-metal frictional engagement between the outer surface of the spindle housing 30 and the inner surface of the tube 4 by confining all such frictional contact to a running engagement between the tube surface and the arcuate sides 35*a*, 35*b* of the self-lubricating bearing 34 (and the arcuate walls 43*a*, 43*b* of the self-lubricating bearing 42 located beneath the bearing 34). Bearing 34 is seatable within a complementary slot 38 located near the distal end 9 of the top cylindrical housing 31. In order that bearing 34 may be positively retained in this complementary slot 38, a spring-loaded detent peg assembly 40 is provided therein. Peg assembly 40 has a threaded exterior which may be screwed into a bore 41 within the bearing 34. Thus positioned, the peg of the peg assembly 40 may be "snap-fitted" into a circular recess 41.1 located within the top cylindrical housing 31 when the bearing 34 is seated within slot 38.

Peening spindle 3*a* further includes a second self-lubricating bearing 42 which is quite similar both in structure and function to the bearing 34. Bearing 42 is preferably also made of a self-lubricating and easily machinable plastic such as Delrin ®, and includes the previously mentioned bore 44 for journalling the axle portion 20 of the enlarged, rigid portion 7 of the mandrel 5. Most importantly, bearing 42 has arcuate walls 43*a*, 43*b* which are dimensioned the same as the arcuate walls 35*a*, 35*b* of bearing 34 in order that the two bearings 34 and 42 coacting together may provide a two-point contact onto the inner wall of the tubes being rotopeened which successfully prevents any portion of the outer surface of spindle housing 30 from coming into frictional contact with the inner wall of the tube 4 being peened. The fact that the outer diameters of the bearings 34, 42 are both only slightly smaller than the inner diameter of the tube 4 being peened helps to maintain a desired stand-off distance S (shown in FIG. 3A) between the inner edges of the flapper leaves 17*a*, 17*b* and the inner surface of the tube 4 as the spindle housng 30 rotates within the tube. This is important, since the resulting peening intensity is at least partially dependent upon this stand-off distance. Finally, bearing 42 likewise contains a spring-loaded detent peg assembly 48 which is threaded along its exterior surface in order that it might be screwed into bore 49. The peg of the spring-loaded detent peg assembly 48 may be "snap-fitted" into a circular recess (not shown) when the bearing 48 is seated within complementary slot 46. Directly below bearing 42 is a U-shaped cavity 62*a* which houses the cylindrical coupling 25 of the mandrel 5.

FIGS. 3A, 3B and 4 best illustrate the cage 50 of the top cylindrical housing 31 of the spindle 3*a*. Generally, the cage 50 consists of a ligament portion 52 having a semicircular exterior 54, and a spiral-shaped cavity 56 which terminates in a flap-receiving rounded edge 58. The ligament portion 52 maintains the alignment between the bores 36 and 44 in the bearings 34, 42 during the operation of the spindle 3*a* by providing both integrality and rigidity to the spindle housing 30. The ligament portion 52 achieves this function with a minimum amount of erosive peening action between it and the peening balls 18 of the flappers 13*a*–13*l* by virtue of the shape of its spiral cavity 56. The interaction between the cavity 56 of the ligament portion 52 and the leaves 17*a*, 17*b* of the peening flappers 13*a*–13*l* is best understood with specific reference to FIGS. 3A and 3B. In FIG.

3A, flapper leaf 17*a* approaches the flap-receiving rounded edge 58, while the peening balls 18 of flap leaf 17*b* begin to ride on the portion of the spiral cavity 56 having the smallest radius. The rigid portion 7 of the mandrel 5 is, of course, rotating counterclockwise in both of these Figures. The centripetal force imparted to the peening balls 18 of the flapper leaf 17*b* by the spinning mandrel 5 causes these balls 18 to ride completely around the spiral-shaped cavity 56 of the ligament portion 52, and "whip" into the wall of the tube 4 in the position shown in FIG. 3B. As will be described in more detail hereinafter under the "method description" section, the angular speed imparted to the peening balls 18 from the rotating mandrel 7 is sufficiently great enough so that the balls 18 effectively cold-work the inner wall of the tube 4 when they strike it, thereby relieving tensile stresses around the inner diameter of the tube 4. At about the same time the peening balls 18 of the flapper leaf 17*b* whippingly strike the inner wall of the tube 4, the opposing flapper leaf 17*a* has engaged the flap-receiving rounded edge 58 of the ligament 52, and begun to "ride" along the spiralled contour of cavity 56. In the preferred embodiment, edge 58 is rounded as shown instead of sharply tapered. Surprisingly, the applicants have found that a rounded edge is more resistant to wear from the peening balls 18 than a knife-type edge. While the mandrel 5 rotates the peening flappers 13*a*–13*l*, the cage 50 also rotates counterclockwise about the longitudinal axis of the tube 4, thereby imparting an orbital component of motion to the rigid, enlarged section 7 of the mandrel 5. This orbital motion allows the peening balls 18 to uniformly strike every point around the circumference of the inner wall of the tube 4. The orbital component of motion may be seen by comparing the orbital position (x) of the mandrel 5 and the ligament 52 in FIG. 3A with the orbital position (x') of these components in FIG. 3B. In reality, this orbital component of motion is much smaller than the rotational component of motion of the mandrel 5 than the drawings of FIGS. 3A and 3B indicate. Specifically, the mandrel 7 rotates at 3,000 to 3,300 rpms, while the cage 50 of the spindle 3*a* rotates at only about 14 to 17 rpms. As has been previously indicated, as the spindle body 30 rotates within a tube 4, the outer surfaces of self-lubricating bearings 34 and 42 contact the inner walls of the tube in running engagement. Because the outer diameters of the self-lubricating bearings 34, 42 are chosen so as to be only slightly smaller than the inner diameter of the tube 4, the two bearings 34, 42 maintain a uniform stand-off distance between the peening leaves 17*a*, 17*b* of the flappers 13*a*–13*l* as the spindle housing 30 rotates within the tube 4.

With reference again to FIG. 4, and to FIG. 5F, the peening spindle 3*a* further includes a bottom cylindrical housing 60 whose distal end is threadedly engageable with the proximal end of the top cylindrical housing 31. The bottom cylindrical housing 60 includes a U-shaped mandrel housing cavity 62*b* which communicates with the U-shaped cavity 62*a* of the top cylindrical housing 31. This U-shaped cavity becomes gradually deeper along the longitudinal axis of the spindle housing 30, and terminates in a mandrel shaft bore 66 which is concentrically disposed within the proximal end 29 of the bottom cylindrical housing 60. In its central section, the U-shaped cavity 62*b* includes a guide sleeve 64 through which the flexible section 23 of the mandrel extends. The guide sleeve 64 is welded or otherwise affixed within the U-shaped cavity 62*b*, and the flexible section 23 of the mandrels is freely rotatable within this sleeve 64. The general function of the gradually deepening U-shaped cavity 62*b* and the guide sleeve 64 is to reorient the flexible section 23 of the mandrel 5 from a concentric alignment with the longitudinal axis of the spindle housing 30, to an off-center alignment with the spindle housing 30 which is consummated at the point where the flexible section 23 of the mandrel is coupled to the shaft portion 21*b* of the rigid, enlarged section 7 of the mandrel 5. As has been previously indicated, such an off-center alignment is necessary if the peening flappers 13*a*–13*l* are to interact properly with the spiral cavity 56 of the cage ligament 52, and whippingly strike against the inner wall of the tube 4. The proximal end 29 of the bottom cylindrical housing 60 terminates in an enlarged annular shoulder 68. Although not specifically shown in FIG. 4, the bottom section of this enlarged shoulder 68 includes a pair of opposing slots for receiving key members extending from the orbital output shafts 186*a*–186*j* of the output gearbox 160. The enlarged shoulder 68 is rotatably captured within a complementary annular recess 70 located at the upper end of a spindle socket 72. The spindle socket 72 has a threaded interior 74 in order that it may be screwed onto the threaded exterior of the orbital output shafts 186*a*–186*j*. As will become more evident hereinafter, when the spindle sockets 72 of the spindles 3*a*–3*j* are threadably joined to the orbital output shafts 186*a*–186*j*, the square ends 27 of the mandrels 5 are seated into complementary, square recesses concentrically located within the rotary output shafts 186*a*–186*j*.

Figure 7A:
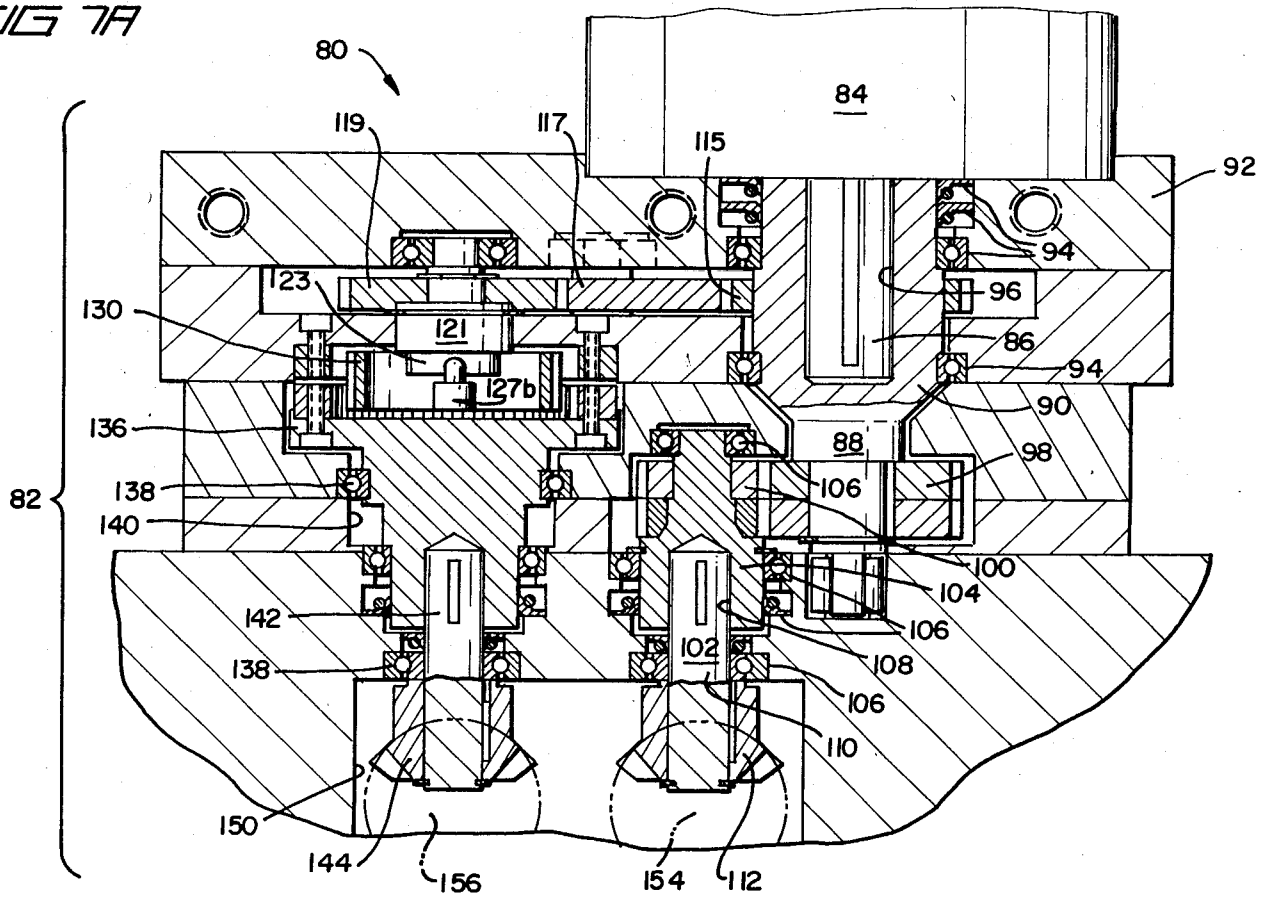
FIG. 7A is a cross-sectional plan view of the input gear assembly of the rotary and orbital drive assembly.

Turning now to FIGS. 1, 7A and 7B and the rotary and oscillatory drive assembly 80 of the multi-spindle rotopeening device 1, drive assembly 80 has a drive train 82 formed from an electric motor 84, an input gear assembly 85, a miter gearbox 150, and the previously mentioned output gearbox 160.

With specific reference now to FIG. 7A, the electric motor 84 includes a drive shaft 86 which is mechanically connected to a drive gear assembly 88 as indicated. In the preferred embodiment, electric motor 84 is a Model 1960, 120-volt, 60 Hz type synchronous motor manufactured by Aerotech-Unidex Corporation of Pittsburgh, Pa. The drive gear assembly 88 includes a shaft 90 which is rotatably mounted within the casing 92 of the input gear assembly 85 by means of ball bearings 94. The shaft 90 of the drive gear assembly 98 has a centrally disposed bore 96 for receiving the drive shaft 86 of the electric motor 84. In operation, the drive shaft 86 rotates the shaft 90 of the drive gear assembly 88 at approximately 1,550 rpms.

Concentrically mounted around the shaft 90 of the drive gear assembly 98 are a rotary mandrel drive gear 98, and an orbital mandrel drive gear 115. The teeth of the rotary mandrel drive gear 98 mesh with the teeth of a speed doubler gear 100, which doubles the angular speed of the shaft 90 from 1,550 rpms to 3,100 rpms. The speed doubler gear is in turn concentrically affixed around the shaft 104 of the miter gear assembly 102. The shaft 104 is journalled within the casing 92 of the input gear assembly 85 and the housing 152 of the miter gearbox 150 by means of ball bearings 106. Shaft 104 has a bore 108 for concentrically receiving the shaft 110 of a miter gear 112. Miter gear 112 serves the function of reorienting the 3,100 rpm output of the speed doubler gear 100 from a horizontal to a vertical direction.

Turning now to the previously mentioned orbital mandrel drive gear 115, the teeth of this gear mesh with the teeth of an idler gear 117 which in turn meshes with the teeth of the input gear 119 of a harmonic drive assembly 121. As may best be seen with respect to both FIGS. 7A and 7B, input gear 119 is concentrically affixed around the input shaft 123 of the harmonic drive assembly 121. This input shaft 123 is connected to a yoke 125 whose ends terminate in a pair of opposing rollers 127*a*, 127*b*. These rollers 127*a*, 127*b* in turn engage against the interior wall of a flexible gear ring or spine 130, known as a "wave generator" in the mechanical gear arts. The flexible gear ring 130 includes a plurality of gear teeth 132 on its outer surface which periodically intermesh with the teeth 135 of a rigid gear spine 134 (which is shaped like a planetary holder gear). The rigid gear spine 134 is in turn connected to an output shaft 136 which is rotatably mounted within both the casing 92 of the input gear assembly 85 and the housing 152 of the miter gearbox 150 by means of bearing 138. Output shaft 138 includes a centrally disposed bore 140 for receiving the shaft 142 of the miter gear 144. Miter gear 144, like neighboring miter gear 112, serves the function of reorienting the rotational output of the harmonic drive assembly 121 from a horizontal to a vertical direction. Because the orbital mandrel drive gear 115 and the input gear 119 of the harmonic drive assembly 121 are the same diameter, the input shaft 123 rotates at the same speed as the output shaft 86 of electric motor 84 (i.e., at 1,550 rpms). However, because the ratio of the teeth 132 and 135 on the flexible gear ring 130 and rigid gear spine 134 are selected so that the output rpms are only 1/100th of the input rpms, the angular speed of miter gear 144 is only about 15.5 rpms.

While harmonic drive assembly 121 resembles in many respects a conventional planetary gear assembly, its operation is fundamentally different, in that 360° rotation of the yoke 125 within the flexible gear ring or spine 130 advances the rigid gear spine an angular distance equal to only about one gear tooth. In more abstract terms, the ratio of transfer of rpms between the input and output shafts of the harmonic drive assembly follows the same waveform as the phenomenon of "beats" formed from a composite of two sound frequencies where one is slightly greater or less than the frequency of the other. Hence, the closer the ratio of the gear teeth of the flexible gear ring or spine 130 to the gear teeth in the rigid gear spine 134 approaches "1", the greater the ratio between the rpms of the input shaft and the output shaft of the harmonic drive assembly 121. In the preferred embodiment, the harmonic drive assembly 121 is a Model HDUF 20 (100:1) manufactured by Emhart Corporation of Wakefield, Md.

With reference now to FIGS. 7A and 9, the miter gearbox 150 of the rotary and oscillatory drive assembly 80 is formed from a housing 152 which contains an input rotary miter gear 154 attached to an output shaft 155, as well as an input orbital miter gear 156 which is similarly connected to another output shaft 157. The teeth of the input rotary miter gear 154 and the input orbital miter gear 156 mesh with the teeth of rotary drive miter gear 112 and the orbital drive miter gear 144. As indicated previously, the function of the pairs of miter gears 112, 154 and 144, 146 is to reorient the rotary and orbital drive trains 90° from the orientation of the output shaft 86 of the electric motor 84 from a horizontal to a vertical direction.

Figure 8:
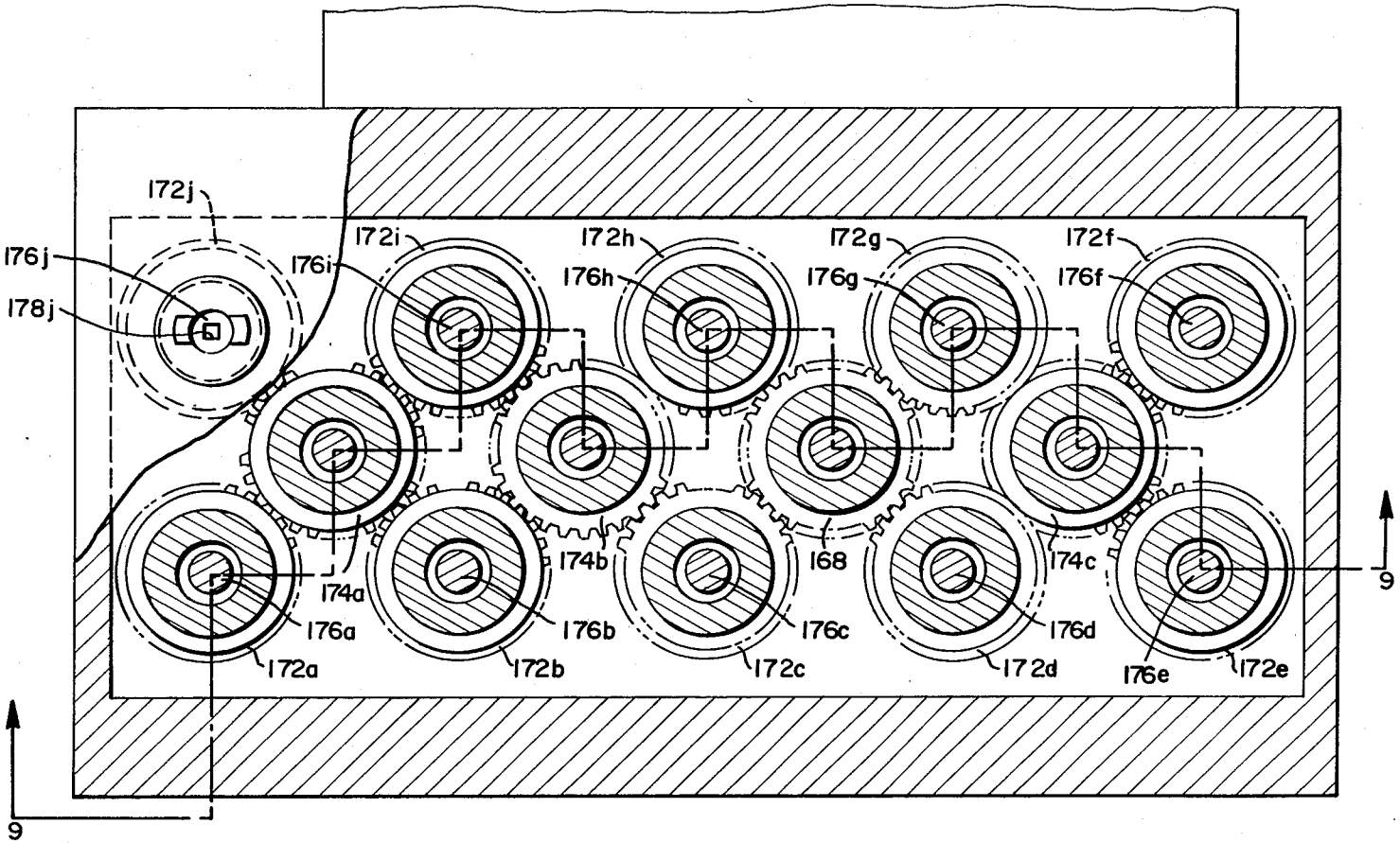
FIG. 8 is a partial, cross-sectional plan view of the multi-spindle output gearbox of the rotary and orbital drive assembly.

FIGS. 8 and 9 illustrate the output gearbox 160 of the rotary and oscillatory drive assembly 80. The output gearbox 160 includes a lower level of gears 162 for driving the rotary output shafts 176*a*–176*j*, and an upper level of gears 164 for driving the orbital output shafts 186*a*–186*j*. As previously mentioned, the rotary output shafts 176*a*–176*j* are concentrically disposed within the orbital output shafts 186*a*–187*j*. The square pitch of the ten orbital output shafts 186*a*–186*j* is identical to the square pitch of the tubes 4 mounted in the tubesheet 221 of a nuclear steam generator in order to permit the spindles 3*a*–3*j* to be simultaneously inserted into and operated within the open ends 219 of these tubes 4. However, in order to attain the desired square pitch between the orbital output shafts 186*a*–186*j*, gears having different radii, and hence different numbers of gear teeth, had to be used. Specifically, the drive gears 168 and 170 and the idler gears 174*a*–174*c* and 184*a*–184*c* of the lower and upper gear levels 162 and 164 each had thirty teeth, while the rotary output gears 172*a*–172*j* and the orbital output gears 182*a*–182*j* each had thirty-one teeth. This in turn prohibited a design wherein all of the gears on the same gear levels 162 or 164 could mutually intermesh without interference. As will be seen shortly, a solution to this problem was achieved by machining off the teeth of some of the gears on each level on either their top or bottom halves so that the teeth of some of the gears on each level would rotate over or under one another without intermeshing. The end result is the extremely compact output gearbox 160.

The gear train of the lower gear level 162 includes a rotary drive gear 168 which forms part of the previously mentioned output shaft 155 of the input rotary miter gear 154. All of the teeth of the rotary drive gear 168 are intact, as is indicated in FIG. 9. Rotary drive gear 168 drives rotary output gears 172*a*–172*j*, as well as three idler gears 174*a*–174*c*. Rotary output gear 172*a* has teeth only at its bottom half, while rotary output gears 172*b*, 172*c* and 172*d* have a full set of teeth on both their top and bottom halves. Rotary output gears 172*e* and 172*f* include teeth only on their bottom halves, while rotary output gear 172*g* includes teeth only on its top half. Further, rotary output gear 172*h* includes teeth only on its bottom half, rotary output gear 172*i* includes teeth only on its top half, and rotary output gear 172*j* includes teeth only on its bottom half. Finally, idler gear 174*a* includes teeth only on its bottom half, idler gear 174*b* includes teeth only on its top half, and idler gear 174*c* includes teeth only on its bottom half.

As previously mentioned, if all of these rotary output gears 172*a*–172*j* and idler gears 174*a*–174*c* mutually intermeshed, the gear train in the lower gear level 162 could not run due to the mechanical interference caused by the fact that the drive and idler gears have thirty teeth, while the rotary output gears have thirty-one teeth. However, the technique of eliminating the gear teeth on either the top or bottom halves of some of these gears allows them to rotate adjacent one another without interference. Hence, the rotary drive gear, having full teeth, may simultaneously intermesh with and rotate surrounding gears 172*c*, 172*d*, 172*g* and 172*h*. Rotary output gear 172*d*, having full teeth, may in turn intermesh with and rotate idler gear 174*c*. However, if the teeth of idler gear 174*c* were allowed to intermesh with the teeth of the rotary output gear 172*g*, interference would result because rotary output gear 172 has an odd number of gear teeth which cannot simultaneously mesh with both the rotary drive gear 168 and the idler gear 174*c*. Hence, the removal of the gear teeth from the bottom of rotary output gear 172*g* and the top of idler gear 174*c* prevents such interference from occurring. Similarly, while idler gear 174*a* may simultaneously drive rotary output gears 172*a*, 172*b* and 172*j* without interference, such interference would occur if the teeth of this gear 174*a* were allowed to engage the teeth of rotary output gear 172*i*. Accordingly, idler gear 174*a* has teeth only on its bottom half, while rotary output gear 172*i* has teeth only on its top half. Idler gears 174*b* and 174*c* operate in exactly the same manner, and to avoid prolixity, a detailed description of the exact manner in which they intermesh with their surrounding gears without interference will not be given here. In closing, it should be noted that each of the rotary output gears 172*a*–172*j* concentrically surrounds a rotary output shaft 176*a*–176*j* which includes a square recess 178*a*–178*j* for receiving the square end 27 of the mandrel 5 of each of the peening spindles 3*a*–3*j*.

Like the lower gear level 162, the upper gear level 164 includes ten orbital output gears 182*a*–182*l*, each of which includes thirty-one teeth. These gears 182*a*–182*j* are journalled directly over the rotary output gears 172*a*–172*j*. The upper gear level likewise includes three idler gears 184*a*–184*c* having thirty teeth apiece which are journalled over the idler gears 174*a*–174*c*, the only difference being that idler gears 184*a* and 184*b* are on either side of the drive gear 170. To avoid interference within the upper level gear train formed by these gears, the gear teeth from either the top or bottom halves of some of the orbital output gears 182*a*–182*j* and idler gears 184*a*–184*c* are removed in precisely the same pattern described in detail with respect to the lower level gear train. It should be noted that the gear train in the lower gear level 162 is driven at 3,100 rpms, while the gear train in the upper gear level 164 is driven at about 15.5 rpms.

Figure 10:
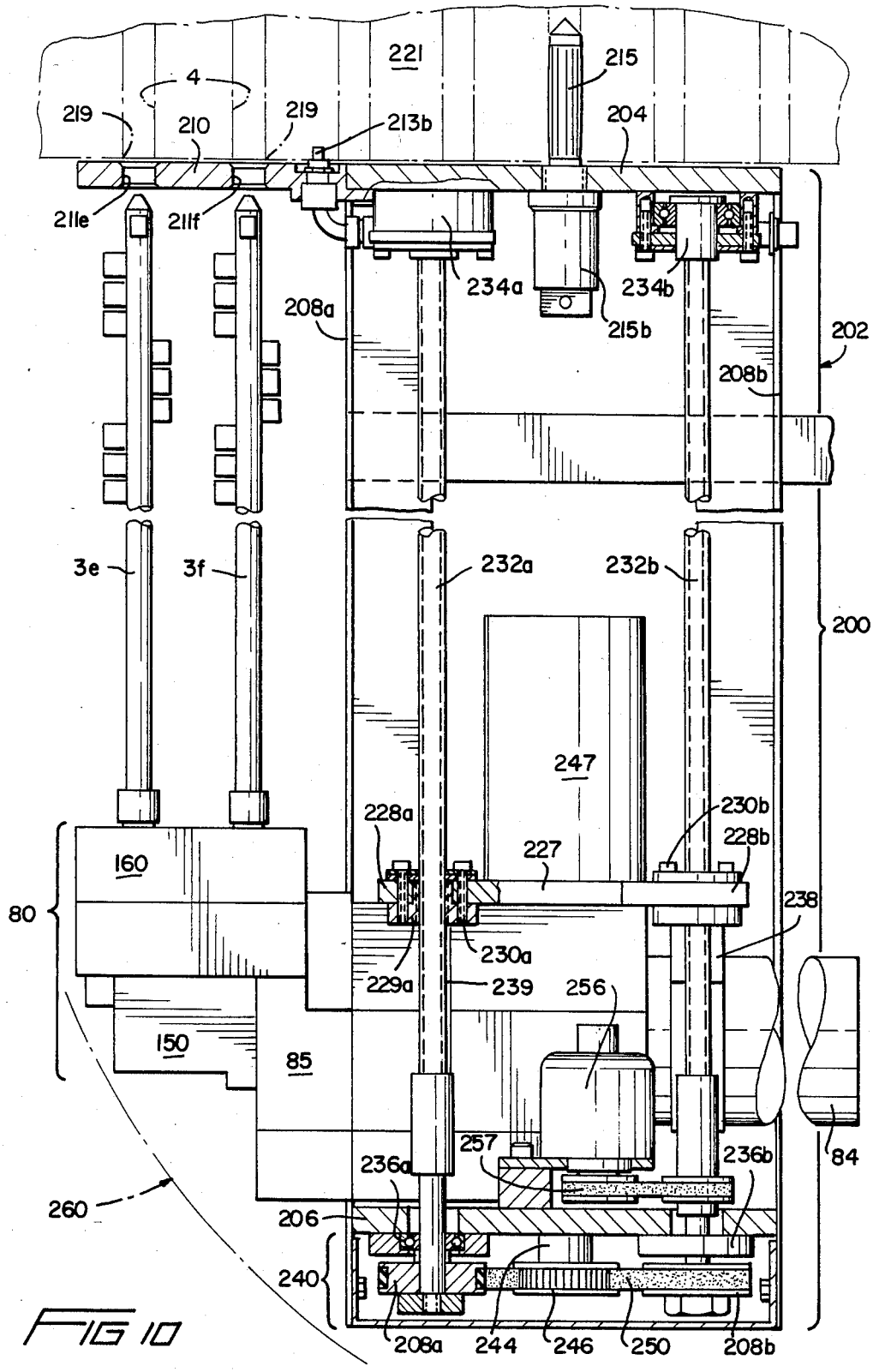
FIG. 10 is a partial, cross-sectional side view of the oscillatory drive assembly of the invention.
Figure 11:
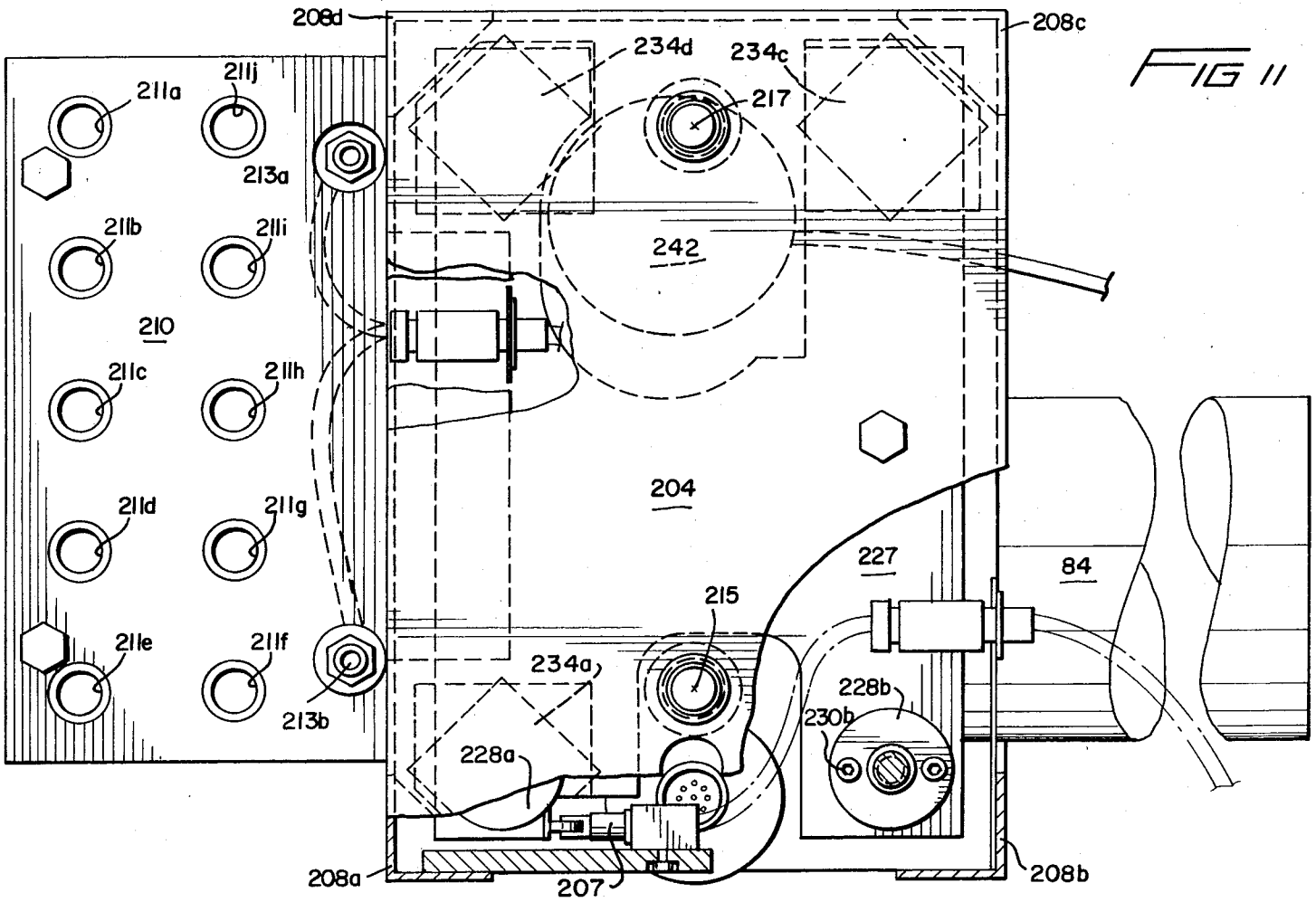
FIG. 11 is a partial, cross-sectional plan view of the drive assembly of FIG. 10.

Turning now to FIGS. 1, 10 and 11, and the oscillatory drive assembly 200 of the multi-spindle rotopeening device 1, this drive assembly includes a frame 202 formed from rectangular top and bottom support plates 204 and 206. The corners of the support plates 204 and 206 are connected together by means of four angular leg members 208*a*–208*d*. The top support plate includes a guide plate 210 having an array of ten apertures 211*a*–211*j* for aligning and guiding the tapered end portions 32 of each of the peening spindles 3*a*–3*j* into the open ends 219 of the tubes 4 mounted in a tubesheet 221. Each of these apertures 211*a*–211*j* is flared at either end in order to render the apertures 211*a*–211*j* more effective in their spindle alignment and insertion function. Top support plate 204 further includes a pair of limit switches 213*a*, 213*b* for transmitting an electrical signal to a control system (not shown) indicative of when the frame 202 is correctly installed in abutting relationship against tubesheet 221. These switches are each connected in parallel to the control system, and a "correct installation" signal is generated only when the states of both the switches change. Finally, top support plate 204 includes a pair of expandable collets 215, 217 for mounting the top plate 204 in firm, abutting relationship against the underside of the tubesheet 221. Each of the expandable collets 215, 217 may be inserted into the open ends 219 of the tubes 204 and expanded therein in order to firmly secure the top plate 204 of the frame 202 in the abutting relationship illustrated in FIG. 10. The preferred embodiment utilizes a Camlock Model 1728E50G02 expandable collet manufactured by Westinghouse Electric Corporation of Pittsburgh, Pa. A further limit switch 207 is connected to angular leg member 208A which generates a signal whenever the rotary and orbital drive assembly 80 connected to the oscillatory drive assembly 200 attains its lowest position within frame 202.

The frame 202 of the oscillatory drive assembly 200 supports an indexing and reciprocating mechanism 225 which translates and reciprocates the rotary and orbital drive assembly 80 and the attached peening spindles 3*a*–3*j* relative to the tubesheet 221. This indexing and reciprocating mechanism 225 includes a rectangular saddle plate 227 having a bronze nut assembly 228*a*–228*d* mounted on each of its four corners. Each of the bronze nut assemblies 228*a*–228*d* includes Oilite® bronze nuts 229*a*–229*d* which are screwed in the saddle plate 227 by means of bolt pairs 230*a*–230*d*. The saddle plate 227 is movably suspended by means of four threaded rods 232*a*–232*d* which are screwed through the bronze nuts 229*a*–229*d* of the bronze nut assemblies 228*a*–228*d*. The ends of each of these threaded rods 228*a*14 228*d* are, in turn, journalled in the top plate 204 and bottom plate 206 of the frame 202 by means of top plate bearings 234*a*–234*d* and bottom plate bearings 236*a*–236*d*, respectively. The saddle plate 227 supports the rotary and orbital drive assembly 80 by means of a pair of U-shaped straps 238, 239 mounted on its underside. Hence, the rotary and oscillatory drive assembly 80 and its attached peening spindles 3*a*–3*j* will translate or reciprocate along the longitudinal axis of the frame 202 in "riding nut" fashion whenever the threaded rods 232*a*–232*d* are simultaneously rotated clockwise or counterclockwise.

Figure 12:
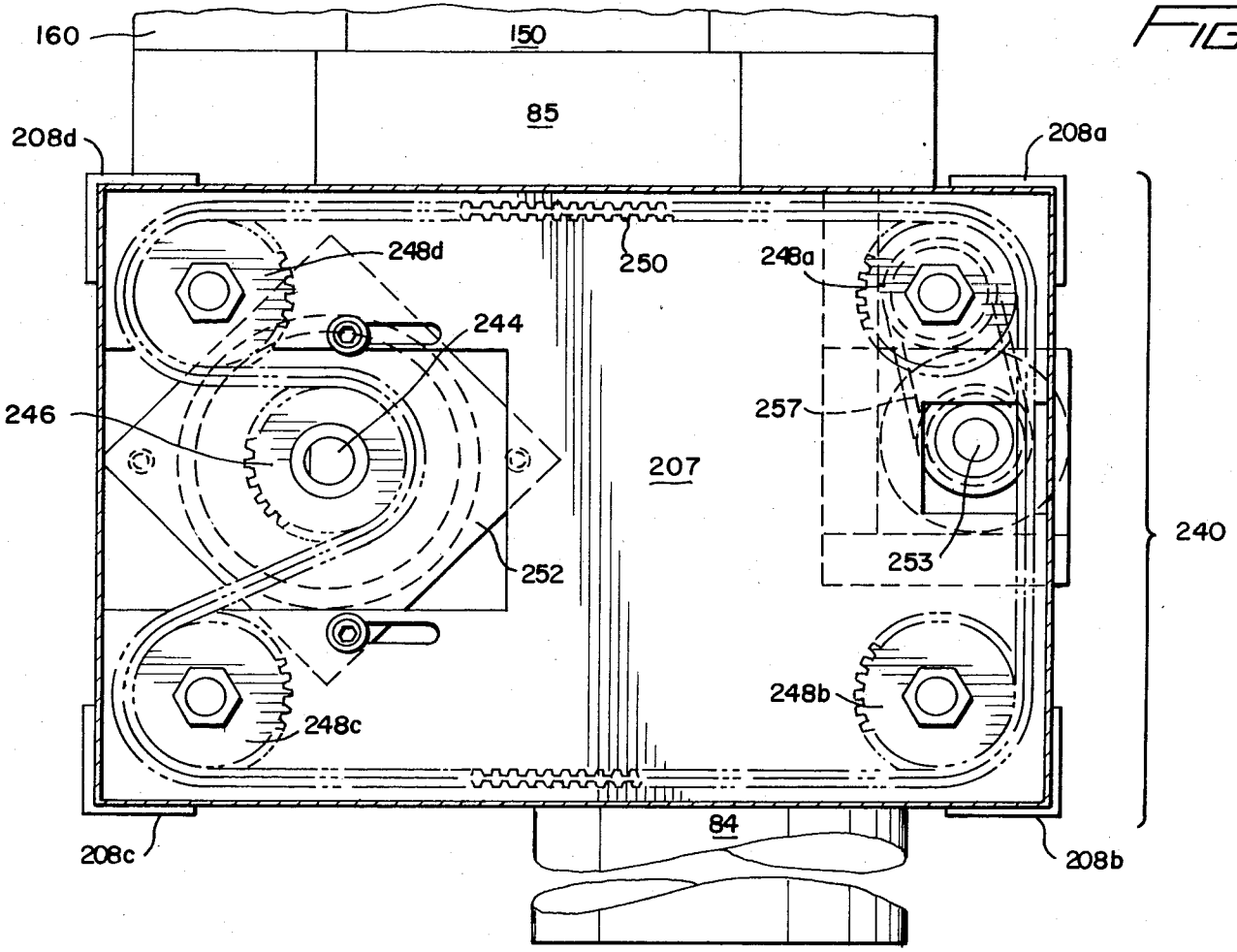
FIG. 12 is a partial, cross-sectional bottom view of this drive assembly.

To control the simultaneous rotation of the threaded rods 232*a*–232*d*, a rod rotating assembly 240 is provided which is best seen with respect to FIGS. 10 and 12. The rod rotating assembly 240 includes an electric motor 242 having an output shaft 244 for driving a drive pulley 246. The drive pulley 246 is coupled to four rod rotating pulleys 248*a*–248*d* by means of a flexible drive belt 250 having gear teeth on either side meshable with the gear teeth of the rotating pulleys 248*a*–248*d*. A motor mounting plate 252 is detachably connected over the drive pulley 246 to afford easy access to the rod rotating assembly 240. Finally, the rotatable rod 232*b* is also connected to the shaft 253 of an optical encoder 255 by means of a belt 257. Since each of the rod rotating pulleys 248*a*–248*d* is identical in size and number of teeth, drive pulley 246 is capable of simultaneously rotating each of the threaded rods 232*a*–232*d* at the same angular speed. The optical encoder 255 generates electrical pulses indicative of the number of revolutions made by each of the rod rotating pulleys 248*a*–248*d*, and transmits these electrical pulses to the aforementioned control system. The control system is preferably formed from a Model III control manufactured by Aerotech-Unidex Corporation of Pittsburgh, Pa., although other types of two-axis controllers which are programmable from an integral keyboard may be used as well. The control system computes the longitudinal distance that the rotating, threaded rods 232*a*–232*d* are moving the peening spindles 3*a*–3*j* on the rotary and oscillatory assembly 80 by counting the net number of counterclockwise rotations made by the rod rotating gears 248*a*–248*d*, and multiplying the net number of these turns against the known pitch of the threads in the threaded rods 232*a*–232*d*. The control system starts the turn count whenever the rods 232*a*–232*d* pull the rotary and orbital drive assembly 80 into contact with the limit switch 207 located on the angular leg 208*a* of the frame 202. The control system is further connected to the D.C. power source of electric motor 242, and controls both the angular speed and the angular direction of the drive gear 246 attached to the output shaft 244 of this motor 242 by varying both the polarity and magnitude of the d.c. power voltage entering the motor 242. In the preferred embodiment, the computer circuit in the control system is programmed to (1) monitor rotational rpms of both the electric motors 84 and 242 of the rotary and orbital drive assembly 80 and oscillatory drive assembly 200, respectively; (2) verify the vertical displacement of the spindles 3*a*–3*j*, and (3) independently monitor the rotopeening time. Additionally, the program logic should provide for a deactuation of both motors 84 and 242 if one or the other stops for any reason. If the rotary and orbital drive assembly motor 84 should continue while the oscillatory drive motor 242 quits, the peening balls 18 could create areas of localized stress in the tubes 4 which would defeat the purpose of the peening operation. On the other hand, if the rotary and orbital drive assembly motor 84 should stop while the oscillatory drive motor 242 continues, the peening flappers 13*a*–13*l* may become damaged.

Specific Description of the Method of the Invention

In the first step of the method of the invention, the multi-spindle rotopeening device 1 is first mounted against the tubesheet 221 of a nuclear stem generator in the position illustrated in FIG. 10. Specifically, the operator of the device slides the expandable collets 215, 217 into the open ends of heat exchange tubes 4 which are adjacent the open ends of other tubes 4 which the operator desires to rotopeen. When the operator is confident that the top support plate 204 is firmly abutting against the lower surface of the tubesheet 221, he manually expands both of the expandable collets 215, 217 by rotating the knurled handles thereof. Next, the operator confirms that the top plate 204 is indeed flatly engaged against the tubesheet 221 by checking the output of the two serially limit switches 213, 213*b*. A positive output from these switches confirms to the operator that the top plate 204 is indeed properly engaged in abutting relationship against the tubesheet 221.

When the top plate 204 is thus positioned, the various flared apertures 211*a*–211*j* of the guide plate 210 automatically come into registry with the open ends 10 of the heat exchange tubes 4 mounted in the tubesheet 221, as is illustrated in FIG. 10. Thus positioned, the multi-spindle rotopeening device 1 is ready to commence the peening of the tubes 4.

Electric motor 84 of the rotary and orbital drive assembly 80 is next actuated, which drives the mandrels 5 of each of the spindles 3*a*–3*j* at 30 rpms, and the housings 30 of each of these spindles stay essentially stationary. Next, the reversible motor 242 of the oscillatory drive assembly 150 is actuated in order to elevate the spindles 3*a*–3*j* slowly through the guide plate 210 in the "riding nut" fashion. Motor 242 first elevates the spindles at a rate of about 0.25 inch per second until all of the flappers 13*a*–13*l* are through the mouth 219 of the tube 4, whereupon the rate of vertical advance increases to 2 inches per second until the spindles 3*a*–3*j* are positioned in their upper index position. Because the peening flappers 13*a*–13*l* are rotating as they are being extended through their respective apertures 211*a*–211*j* in the guide plate 210, they will "feed" into the flared ends of these apertures 211*a*–211*j* smoothly and without binding.

As the indexing and reciprocating mechanism 225 lifts the peening spindles 3*a*–3*j* into their uppermost index position within the tubes 4, the optical encoder 255 generates a pulse with every rotation of the drive pulley 246 of the rod rotating assembly 240. These pulses are received and counted by the control system of the invention. The computer circuit of the control system momentarily switches off the reversible motor 242 which drives the indexing and reciprocating mechanism 225 of the oscillatory drive assembly after it counts a number of pulses which indicates that the spindles 3*a*–3*j* have achieved their uppermost index position. Thereafter, the computer circuit simultaneously orders the rotary and orbital drive motor to drive the mandrels 3*a*–3*j* at 3,100 rpms and the reversible motor 242 to alternately rotate clockwise and counterclockwise so as to oscillate the spindles 3*a*–3*j* at a frequency of between 27 and 32 cycles per minute and an amplitude of approximately 0.65 inch within the tubes 4. Such an amplitude has been found to overlap the various helical paths which the peening balls 18 of the peening flappers 17*a*, 17*b* trace as they are rotated, orbited and oscillated within the tubes 4 so that the resulting peening pattern is uniform in intensity at all points. While other amplitudes may be used in connection with the peening spindles 3*a*–3*j*, such amplitudes should be chosen so that each longitudinal increment of the tube being peened is struck approximately the same number of times by the peening balls 18 of the flappers 13*a*–13*l*. Other oscillatory frequencies may be used instead of 27–32 cycles per minute; however, the oscillatory frequency should be chosen so that it is not a multiple of the orbital rpms in order to avoid a situation where the peening balls 18 impinge the inner wall of the tubes 4 along the same helical paths with rotation of the cages 50 of the spindles 3*a*–3*j*. Such constructive interference between the orbital and oscillatory frequencies could create areas of localized stress within the tube which could in turn defeat the purpose of the operation.

The flappers 13*a*–13*l* of each of the spindles 3*a*–3*j* are rotated and orbited at angular speeds of 3,100 and 15.5 rpms for an amount of time sufficient to peen the inner wall of the tubes to a peening intensity of approximately 10A on the Almen scale. When the stand-off distance S between the inner edge of the flapper leaves 17*a*, 17*b* and the inner surface of the tubes 4 is 100 mils, the amount of time that the spindles 3*a*–3*j* peen the tubes in the upper index position is approximately four minutes. After this four minute time period has expired, the computer circuit of the control system lowers the peening spindles 3*a*–3*j* to a middle index position, and then oscillates these spindles in the manner previously described for an additional four minutes. After this second four minute time period has expired, the computer circuit lowers the spindles 3*a*–3*j* to a bottommost index position, and oscillates the spindles 3*a*–3*j* for a final four minutes. Thereafter, the computer circuit lowers the spindles back to the lowermost position illustrated in FIG. 10, thereby removing the spindles 3*a*–3*j* from the tubes 4 and depressing limit switch 207, which "zeroes out" the computer's count of the pulses it has received from the optical encoder 255. The topmost, middle and bottommost index positions are chosen so that the resulting peening patterns are contiguous with one another in order to ensure a uniform peening intensity along longitudinal sections of the tubes 4 being peened.

Figure 13:
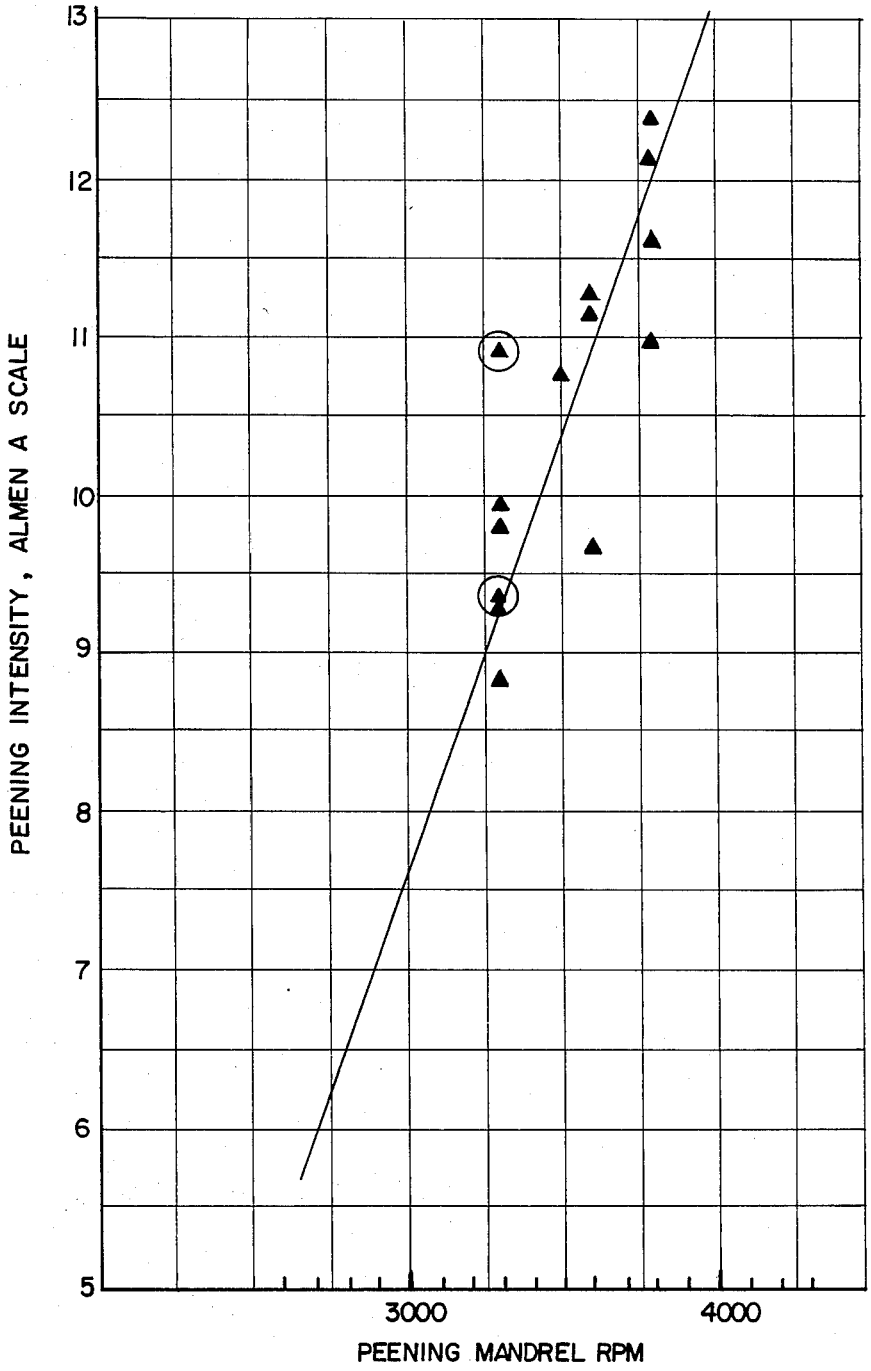
FIG. 13 is a graph illustrating the relationship between the peening mandrel rpms and the resulting peening intensity after four minutes.
Figure 14:
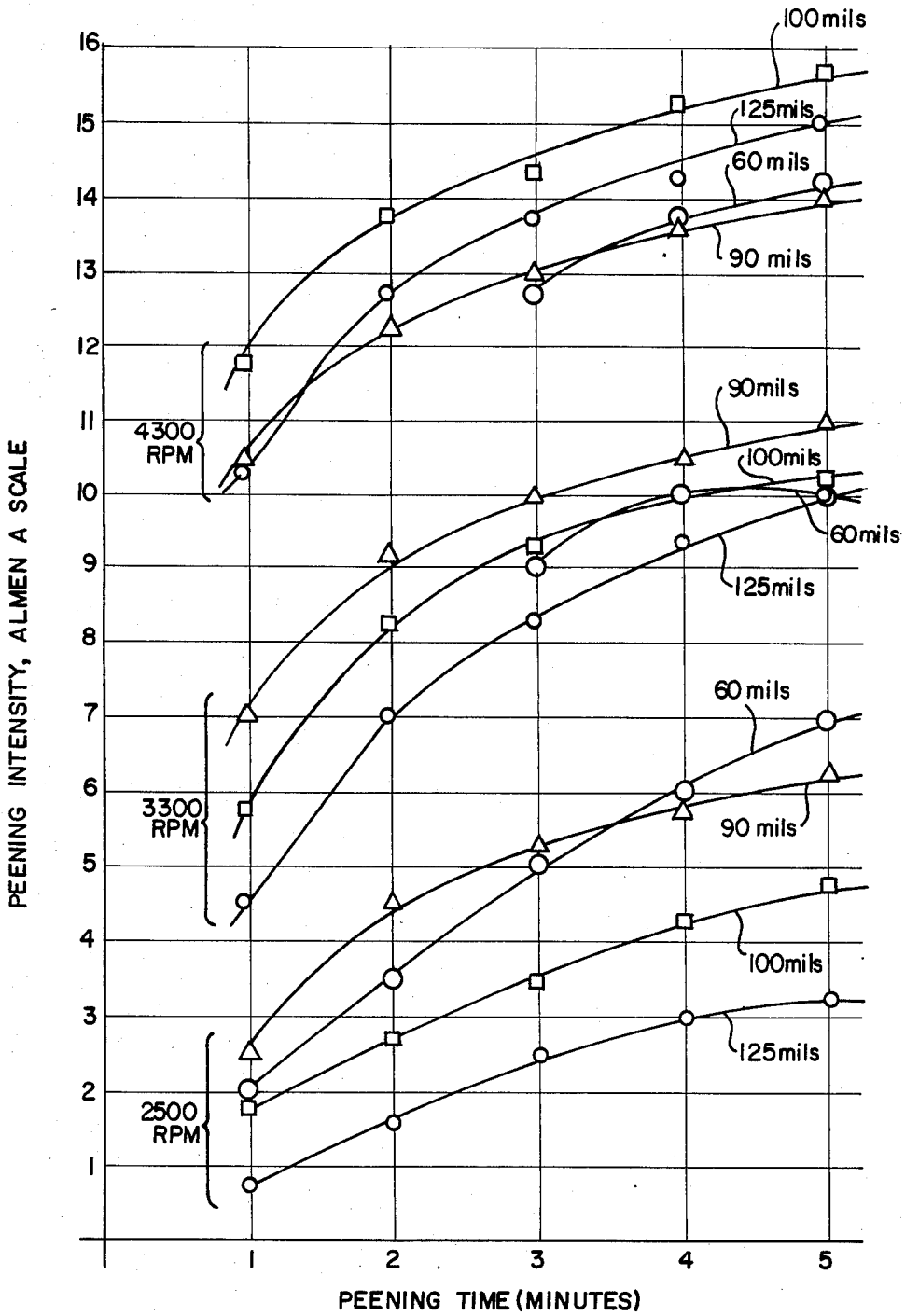
FIG. 14 is a graph illustrating the relationship between the rate at which a given peening intensity is achieved at various mandrel rpms and various stand-off distances.

The specific mandrel rpms and stand-off distances used in the method of the invention may vary, depending on such factors as the inner diameter of the tubes, the specific metallurgical properties of the materials forming the tubes, and the peening intensity desired. However, the data provided on the graphs of FIGS. 13 and 14 indicate that the foregoing mandrel rpms and stand-off distances are optimal when a peening intensity of 10A is desired around the inner wall of a tube formed from Inconel 600. As used herein, the "optimal" combination of such peening parameters is that combination of mandrel rpms and flapper stand-off distance which most accurately results in a final peening intensity of approximately 10A in the shortest manageable time. FIGS. 13 and 14 indicate that the optimum combination is indeed a mandrel angular speed of approximately 3,000 to 3,300 rpms at a stand-off distance of approximately 60 to 125 mils, over a time period of approximately four minutes at each index position.

Specifically, FIG. 14 illustrates the relationship between peening intensity over time for mandrel angular speeds of 2,500 rpms, 3,300 rpms and 4,300 rpms. In all cases, the curve formed by the interconnection of the small circles indicates that the test was run at a stand-off distance of 125 mils, while the graphs formed by the interconnection of squares, triangles and large circles indicate stand-off distances of 100 mils, 90 mils and 60 mils, respectively. While it is clear from the results of this graph that a mandrel rotational speed of 4,300 rpms can result in a peening intensity of 10A very rapidly (i.e., in less than one minute), the near-vertical slope of these curves in the vicinity of 10A also indicates that the accurate achievement of a 10A peening intensity would be difficult, if not impossible. In other words, an under-peening or over-peening condition could easily result at this angular speed if the rotary and orbital drive assembly 80 were left on or turned off a few seconds too late or too soon. By contrast, while each one of the four curves recorded for a mandrel angular speed of 2,500 rpms would seen to offer an extremely flat peening rate curve in the vicinity of a peening intensity of 10A (assuming they were extrapolated over time), it is clear that a peening intensity of 10A could be achieved only after an inordinate amount of time had expired.

From the foregoing discussion, it is clear that a mandrel angular speed of about 3,000 to 3,300 rpms at a stand-off distance between 60 and 125 mils offers the most desirable balance between the conflicting goals of accurate peening control versus minimum time. The peening intensity curves at each of these four stand-off distances are very flat in the vicinity of the desired peening intensity of 10A, which indicates that accurate control of the final peening intensity may be easily achieved. Stated another way, the operation of the rotary and orbital drive assembly 80 a few seconds more or less than four minutes will not materially affect the resulting peening intensity to any great extent. Moreover, while the four minute time period required to achieve a peening intensity of 10A is not a short as the one minute or less times which may be achieved at a mandrel speed of 4,300 rpms, it is at least a reasonable compromise in view of the significant amount of peening intensity control associated therewith.

While the graphs of FIG. 14 indicate that stand-off distances between 60 and 125 mils may be used, the distances affording a maximum amount of flatness in the vicinity of a 10A peening intensity are the most preferred due to the paramount importance of peening control. While the graph indicates that stand-off distances of both 60 mils and 100 mils offer extremely flat peening intensity curves in the 10A region, the 100 mils stand-off distance is preferred since it results in less wear to the flap-receiving rounded edge 58 of the cage 50 of the spindles 3*a*–3*j*.

We claim as our invention:

1. An apparatus for rotopeening the inside wall of a conduit, comprising:

(a) at least one peening spindle which is insertable within the conduit and which includes a rotatable housing which substantially encloses a rotatable mandrel having a peening means, wherein said mandrel is journalled within the housing in an off-center relationship;

(b) a rotary and orbital drive assembly having a co-axial drive shaft which is coupled to the housing and the mandrel of the peening spindle for simultaneously rotating and orbiting said peening means within said conduit, and (c) an oscillatory drive assembly coupled to the rotary and orbital drive assembly for reciprocating said peening means within said conduit while said peening means rotates and orbits.

2. The apparatus of claim 1, wherein said oscillatory drive assembly inserts said spindle a desired extent into the conduit so that the peening means is positioned to a desired point along the longitudinal axis of the conduit, and reciprocates the peening means about this desired point at a selected frequency while the peening means rotates and orbits within said conduit.

3. The apparatus of claim 1, wherein said oscillatory drive assembly further positions said spindle adjacent the open end of said conduit in order that said spindle can be inserted into the conduit to a desired extent.

4. The apparatus of claim 1, wherein said oscillatory drive assembly includes a frame for carrying said rotary and orbital drive means, and for positioning the spindle adjacent the conduit.

5. The apparatus of claim 1, wherein said oscillatory drive assembly includes a least one threaded rod which is threadedly engaged to the rotary and orbital drive means and coupled to a reversible drive means for inserting the spindle a desired extent into the conduit so that the peening means is positioned to a desired point along the longitudinal axis of the conduit, and for reciprocating the peening means within the conduit while said peening means rotates and orbits within the conduit.

6. The apparatus of claim 1, wherein said rotary and orbital drive assembly includes a drive train which includes a rotary drive shaft concentrically disposed within an orbital drive shaft detachably connectable to the mandrel and housing, respectively.

7. The apparatus of claim 6, wherein said drive train includes an output gear box having a plurality of rotary drive shafts concentrically disposed within orbital drive shafts for driving a plurality of peening spindles.

8. The apparatus of claim 1, including a plurality of spindles, each of which is coupled to said rotary and orbital drive assembly, for simultaneously rotopeening a plurality of conduits.

9. The apparatus of claim 8, wherein said oscillatory drive assembly includes a frame for carrying said rotary and orbital drive means, and for positioning the spindles within a plurality of conduits.

10. An apparatus for uniformly rotopeening the inside wall of a conduit having an open end, comprising:

(a) at least one peening spindle which is insertable through the open end of the conduit and which includes a substantially closed, rotatable housing with a mandrel rotatably mounted therein in an off-center relationship with at least one peening means attached thereto;

(b) a rotary and orbital drive assembly including a power train having a rotary drive shaft concentrically disposed within an orbital drive shaft coupled to said rotatable mandrel and said housing respectively, for rotating and orbiting said peening means within said conduit, and (c) an oscillatory drive assembly operatively connected to said rotary and orbital drive assembly for inserting said spindle a desired extent into said conduit so that the peening means is positioned to a desired point along the longitudinal axis of the conduit, and for reciprocating the peening means about this desired point while the peening means rotates and orbits within the conduit.

11. The apparatus of claim 10, wherein said oscillatory drive assembly includes a frame for carrying said rotary and orbital drive assembly and for positioning said spindle in registry with the open end of the conduit in order that the spindle can be inserted into the conduit.

12. The apparatus of claim 11, wherein said frame includes a guide plate having at least one aperture for guiding said spindle into the open end of the conduit.

13. The apparatus of claim 11, wherein said oscillatory drive assembly includes means for indexing and reciprocating said rotary and orbital drive assembly within said frame in order that said peening means attached to the mandrel of the spindle reciprocates within a desired longitudinal portion of said conduit while said peening means rotates and orbits.

14. The apparatus of claim 13, wherein said means for indexing and reciprocating includes at least one threaded rod whose ends are journalled within the frame, and which is both threadedly engaged to the rotary and orbital drive assembly and coupled to the output shaft of a reversible motor.

15. The apparatus of claim 14, wherein said indexing and reciprocating means includes a saddle plate having a riding nut engaged to said threaded rod for supporting, indexing and reciprocating said rotary and orbital drive assembly as said threaded rod is rotated by said reversible motor.

16. The apparatus of claim 14, including control means for controlling the angular direction and speed of the reversible motor.

17. The apparatus of claim 16, wherein said control means includes an optical encoder which is optically coupled to the output shaft of the reversible motor, and electrically connected to a computer circuit.

18. The apparatus of claim 17, wherein said control means further includes a limit switch mounted on said frame and electrically connected to said computer circuit for producing an electric signal when said rotary and orbital drive assembly approaches one of the ends of said frame.

19. The apparatus of claim 10, wherein said rotary drive shaft is concentrically disposed within the orbital drive shaft.

20. An apparatus for simultaneously rotopeening the inside wall of an array of tubes, each of which has an open end, comprising:

(a) a plurality of rigid peening spindles, each of which is insertable through the open end of one of said tubes, and each of which includes a rotatable madnrel with at least one peening flapper attached thereto, and a substantially closed housing having a rotatable, off-center journalling means for journalling and orbiting said mandrel around the longitudinal axis of the tube;

(b) a rotary and orbital drive assembly including an output gear box having a plurality of orbital drive shafts coupled to said housing for orbiting said mandrel, and a plurality of rotary drive shafts arranged within said orbital drive shafts and coupled to said mandrels for rotating said mandrels, wherein said plurality of orbital drive shafts and their respective rotary drive shafts are arranged so that the spindles coupled thereto are registrable with the open ends of said array of tubes, an (c) an oscillating drive assembly operatively connected to said rotary and orbital drive assembly for registering said spindles with said open ends of said tubes, inserting said spindles a desired extent within said tubes so that the peening flapper associated with each spindle is positioned adjacent a desired point along the longitudinal axis of its respective tube, and for reciprocating the peening flapper about this desired point while the peening means rotates and orbits within its tube.

21. The apparatus of claim 20, wherein said oscillatory drive assembly includes a frame for carrying said rotary and orbital drive assembly, and wherein said frame includes means for detachably connecting said frame to one of said plurality of conduits in order to position said spindles adjacent the open ends of said array of conduits.

22. The apparatus of claim 21, wherein said means for detachably connecting said frame is at least one expandable collet insertable within the open end of one of said tubes.

23. The apparatus of claim 21, wherein said frame includes a guide plate having a plurality of apertures registrable with both the distal ends of the spindles and the open ends of the array of tubes for guiding the spindles into the open ends of the tubes.

24. The apparatus of claim 21, wherein said oscillatory drive assembly includes means for indexing and reciprocating said rotary and orbital drive assembly within said frame in order that said peening flappers associated with said spindles reciprocate within desired longitudinal portions of said tubes while the spindle mandrels rotate and orbit said flappers.

25. The apparatus of claim 24, wherein said means for indexing and reciprocating includes at least one threaded rod whose ends are journalled within the frame, and which is both threadedly engaged to the rotary and orbital drive assembly and coupled to the output shaft of a reversible motor.

26. The apparatus of claim 25, wherein said indexing and reciprocating means includes a saddle plate having a riding nut engaged to said threaded rod for supporting, indexing and reciprocating said rotary and orbital drive assembly as said threaded rod is rotated by said reversible motor.

27. The apparatus of claim 26, further comprising a control means for controlling the angular direction and speed of the reversible motor, including an optical encoder which is optically coupled to the output shaft of the optical encoder and electrically connected to a computer circuit.

28. The apparatus of claim 27, wherein said control means further includes a limit switch mounted on said frame and electrically connected to said computer circuit for producing an electric signal when said rotary and orbital drive assembly approaches one of the ends of said frame.

29. An apparatus for simultaneously rotopeening an array of tubes having open ends mounted in a tubesheet, comprising:

(a) a plurality of rigid peening spindles, each of which is insertable through the open end of one of said tubes, and each of which includes a rotatable mandrel with at least one peening flapper attached thereto, and a housing including a rotatable, off-center journalling means for journalling and orbiting said mandrel around the longitudinal axis of the tube;

(b) a rotary and orbital drive assembly including a power train formed from an input gear box coupled to a motor, and an output gear box coupled to the input gear box, wherein said output gear box includes a plurality of orbital drive shafts detachably connectable to said housing of said spindles for orbiting the mandrels associated with each of the spindles, and a plurality of rotary drive shafts concentrically arranged within said orbital drive shafts and detachably connectable to the mandrels of each of the spindles for rotating said mandrels, wherein the plurality of orbital drive shafts and their respective rotary drive shafts are arranged so that the spindles connected thereto are registrable with the open ends of the tubes in said tubesheet, and (c) an oscillating drive assembly having a frame for carrying said rotary and orbital drive assembly, and means for indexing and reciprocating said rotary and orbital drive assembly within said frame in order that said spindles may be inserted into the open ends of the tubes to a selected extent so that said peening flapper associated with each spindle is positioned adjacent a desired point along the longitudinal axis of its respective tube, and for reciprocating the peening flapper about this desired point at a selected frequency and amplitude while the peening flapper rotates and orbits within its tube.

30. An apparatus for uniformly rotopeening the inside wall of a conduit having an open end, comprising:

(a) at least one peening spindle which is insertable through the open end of the conduit and which includes a rotatable mandrel with at least one peening means attached thereto, and means for orbiting said mandrel and peening means around the longitudinal axis of said conduit;

(b) a rotary and orbital drive assembly including a power train having a rotary drive shaft and an orbital drive shaft coupled to said rotatable mandrel and said means for orbiting said mandrel, respectively, for rotating and orbiting said peening means within said conduit;

(c) an oscillatory drive assembly operatively connected to said rotary and orbital drive assembly for inserting said spindle a desired extent into said conduit so that the peening means is positioned to a desired point along the longitudinal axis of the conduit, and for reciprocating the peening means about this desired point while the peening means rotates and orbits within the conduit;

(d) a frame for carrying said rotary and orbital drive assembly and for positioning said spindle in registry with the open end of the conduit in order that the spindle can be inserted into the conduit;

(e) means for indexing and reciprocating said rotary and orbital drive assembly within said frame in order that said peening means attached to the mandrel of the spindle reciprocates within a desired longitudinal portion of said conduit while said peening means rotates and orbits, including at least one threaded rod whose ends are journalled within the frame, and which is both threadedly engaged to the rotary and orbital drive assembly and coupled to the output shaft a reversible motor, and (f) control means for controlling the angular direction and speed of the reversible motor of the indexing and reciprocating means, including an optical encoder which is optically coupled to the output shaft of the reversible motor, and electrically connected to a computer circuit.

31. The apparatus of claim 30, wherein said control means further includes a limit switch mounted on said frame and electrically connected to said computer circuit for producing an electric signal when said rotary and orbital drive assembly approaches one of the ends of said frame.

32. An apparatus for uniformly rotopeening the inside wall of a conduit having an open end, comprising:

(a) at least one peening spindle which is insertable through the open end of the conduit and which includes a rotatable mandrel with at least one peening means attached thereto, and means for orbiting said mandrel and peening means around the longitudinal axis of said conduit;

(b) a rotary and orbital drive assembly including a power train having a rotary drive shaft and an orbital drive shaft coupled to said rotatable mandrel and said means for orbiting said mandrel, respectively, for rotating and orbiting said peening means within said conduit, wherein said rotary drive shaft is concentrically disposed within the orbital drive shaft, and (c) an oscillatory drive assembly operatively connected to said rotary and orbital drive assembly for inserting said spindle a desired extent into said conduit so that the peening means is positioned to a desired point along the longitudinal axis of the conduit, and for reciprocating the peening means about this desired point while the peening means rotates and orbits within the conduit.

33. An apparatus for simultaneously rotopeening the inside wall of an array of tubes, each of which has an open end, comprising:

(a) a plurality of rigid peening spindles, each of which is insertable through the open end of one of said tubes, and each of which includes a rotatable mandrel with at least one peening flapper attached thereto, and a rotatable, off-center journalling means for journalling and orbiting said mandrel around the longitudinal axis of the tube;

(b) a rotary and orbital drive assembly including an output gear box having a plurality of orbital drive shafts coupled to said off-center journalling means of said spindles for orbiting said mandrel, and a plurality of rotary drive shafts arranged with said orbital drive shafts and coupled to said mandrels for rotating said mandrels, wherein said plurality of orbital drive shafts and their respective rotary drive shafts are arranged so that the spindles coupled thereto are registrable with the open ends of said array of tubes, and (c) an oscillating drive assembly operatively connected to said rotary and orbital drive assembly for registering said spindles with said open ends of said tubes, inserting said spindles a desired extent within said tubes so that the peening flapper associated with each spindle is positioned adjacent a desired point along the longitudinal axis of its respective tube, and for reciprocating the peening flapper about this desired point while the peening means rotates and orbits within its tube;

(d) a frame for carrying said rotary and orbital drive assembly, and wherein said frame includes means for detachably connecting said frame to one of said plurality of conduits in order to position said spindles adjacent the open ends of said array of conduits, and (e) means for indexing and reciprocating said rotary and orbital drive assembly within said frame in order that said peening flappers associated with said spindles reciprocate within desired longitudinal portions of said tubes while the spindle mandrels rotate and orbit said flappers.

34. The apparatus of claim 33, wherein said means for indexing and reciprocating includes at least one threaded rod whose ends are journalled within the frame, and which is both threadedly engaged to the rotary and orbital drive assembly and coupled to the output shaft of a reversible motor.

35. The apparatus of claim 34, wherein said indexing and reciprocating means includes a saddle plate having a riding nut engaged to said threaded rod for supporting, indexing and reciprocating said rotary and orbital drive assembly as said threaded rod is rotated by said reversible motor.

36. The apparatus of claim 35, further comprising a control means for controlling the angular direction and speed of the reversible motor, including an optical encoder which is optically coupled to the output shaft of the optical encoder and electrically connected to a computer circuit.

37. The apparatus of claim 36, wherein said control means further includes a limit switch mounted on said frame and electrically connected to said computer circuit for producing an electric signal when said rotary and orbital drive assembly approaches one of the ends of said frame.

38. An apparatus for uniformly rotopeening the inside wall of a conduit having an open end, comprising:

(a) at least one peening spindle which is insertable through the open end of the conduit and which includes a rotatable mandrel with at least one peening means attached thereto; and means for orbiting said mandrel and peening means around the longitudinal axis of said conduit;

(b) a rotary and orbital drive assembly including a power train having a rotary drive shaft and an orbital drive shaft coupled to said rotatable mandrel and said means for orbiting said mandrel, respectively, for rotating and orbiting said peening means within said conduit, and (c) an oscillatory drive assembly operatively connected to said rotary and orbital drive assembly for inserting said spindle a desired extent into said conduit so that the peening means is positioned to a desired point along the longitudinal axis of the conduit, and for reciprocating the peening means about this desired point while the peening means rotates and orbits within the conduit.

* * * * *